US007327964B2

(12) United States Patent
Funabiki et al.

(10) Patent No.: US 7,327,964 B2
(45) Date of Patent: Feb. 5, 2008

(54) IMAGE FORMING APPARATUS FOR FIXING AN IMAGE

(75) Inventors: Hiroshi Funabiki, Hachioji (JP); Toshiki Hayami, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 107 days.

(21) Appl. No.: 11/289,691

(22) Filed: Nov. 30, 2005

(65) Prior Publication Data

US 2006/0198646 A1 Sep. 7, 2006

(30) Foreign Application Priority Data

Mar. 3, 2005 (JP) ..... 2005-058629

(51) Int. Cl.
*G03G 15/20* (2006.01)
*G03G 15/00* (2006.01)

(52) U.S. Cl. ..... 399/45; 399/67

(58) Field of Classification Search ..... 399/45, 399/33, 67, 69

See application file for complete search history.

(56) References Cited

U.S. PATENT DOCUMENTS

2001/0003560 A1* 6/2001 Yokosuka et al. ..... 399/69
2005/0191074 A1* 9/2005 Matsumoto ..... 399/69

FOREIGN PATENT DOCUMENTS

| | | | |
|---|---|---|---|
| JP | 06004003 A | * | 1/1994 |
| JP | 9-311580 | | 12/1997 |
| JP | 2000-019926 | | 1/2000 |
| JP | 2003-058024 | | 2/2003 |
| JP | 2004-070056 | | 3/2004 |

* cited by examiner

*Primary Examiner*—Quana Grainger
(74) *Attorney, Agent, or Firm*—Finnegan, Henderson, Farabow, Garrett & Dunner, L.L.P.

(57) ABSTRACT

An image forming apparatus, includes: a fixation device comprising a plurality of heaters; and a control unit which performs energization control for the plurality of heaters, wherein any one of at least three priorities which are first, second and third priorities for energizing the plurality of heaters so that power consumptions of the heaters does not exceed a predetermined total power consumption is given to each of the plurality of heaters in response to an operation state of the image forming apparatus, and the control unit performs the energization control for the heaters to which the first priority and the second priority are given when the image forming apparatus is in the operation state, does not energize the heater to which the third priority is given while the heater to which the second priority is given is energized, and performs the energization control for the heater to which the third priority is given while the heater to which the second priority is given is not energized.

6 Claims, 8 Drawing Sheets

FIG.2B

PLAIN PAPER

| HEATER(H) | A | B | C | D | E | TOTAL(W) |
|---|---|---|---|---|---|---|
| POWER CONSUMPTION(W) | 810 | 640 | 300 | 300 | 250 | 2300 |
| WARMING UP | ◎ | ◎ | △ | ○ | ◎ | 2000 |
| IMMEDIATELY AFTER START OF PAPER FEEDING | ◎ | ◎ | ○ | △ | ◎ | 2000 |
| UNDER PAPER FEEDING | ◎ | ◎ | △ | ○ | ◎ | 2000 |
| STANDBY | × | × | ◎ | ◎ | ◎ | 850 |

FIG.2C

THICK PAPER

| HEATER(H) | A | B | C | D | E | TOTAL(W) |
|---|---|---|---|---|---|---|
| POWER CONSUMPTION(W) | 810 | 640 | 300 | 300 | 250 | 2300 |
| WARMING UP | ◎ | ◎ | △ | ○ | ◎ | 2000 |
| IMMEDIATELY AFTER START OF PAPER FEEDING | ◎ | ◎ | ○ | △ | ◎ | 2000 |
| UNDER PAPER FEEDING | ◎ | ◎ | △ | ○ | ◎ | 2000 |
| STANDBY | × | × | ◎ | ◎ | ◎ | 850 |

FIG.2D

| HEATER(H) | A | B | C | D | E | TOTAL(W) |
|---|---|---|---|---|---|---|
| POWER CONSUMPTION(W) | 810 | 640 | 300 | 300 | 250 | 2300 |
| WARMING UP | ◎ | ◎ | △ | ○ | ◎ | 2000 |
| IMMEDIATELY AFTER START OF PAPER FEEDING | ◎ | ◎ | ○ | △ | ◎ | 2000 |
| UNDER PAPER FEEDING | ◎ | ◎ | △ | ○ | ◎ | 2000 |
| STANDBY | × | × | ◎ | ◎ | ◎ | 850 |

*PRIOR ART*

IMAGE FORMING APPARATUS FOR FIXING AN IMAGE

BACKGROUND OF THE INVENTION

1. Field of the Invention

The present invention relates to an image forming apparatus as a copier, a printer, a facsimile machine, or a compound machine thereof, and particularly to an image forming apparatus including a fixation device for fixing a toner image formed by an electrophotographic system to a transfer sheet.

2. Description of the Related Art

Recently, it has been made possible to obtain a large amount of image information and the like owing to a development of a communication network such as the Internet. In order to process such information, an image forming apparatus as a copier, a printer, a facsimile machine, or a compound machine thereof has been required more to have performance capable of forming a large amount of high-quality color images and the like at a high speed.

It is frequent that an image forming apparatus which forms an image by an electrophotographic system is used as such an image forming apparatus. In the above-described image forming apparatus, there is provided a fixation device for developing, by a toner, an electrostatic latent image formed based on the image information, and fixing an emerging toner image to a transfer sheet.

As the fixation device, there are known one which includes a fixing roller as a fixing member, and a pressure roller, each having a heater therein, and is constructed to form a pressure contact portion by bringing the fixing roller and the pressure roller into pressure contact with each other, one which is constructed to form a pressure contact portion by bringing a fixing roller member and a pressure roller into pressure contact with each other, in which the fixing roller member is formed by extending a fixing belt between a heating roller having a heater therein and a fixing roller, and the pressure roller is a pressure member also having a heater therein, and the like. In any of the above-described fixation devices, the transfer sheet to which the toner image is transferred is inserted into the pressure contact portion of the fixing roller and the pressure roller. Then, the toner is heated and pressurized by the pressure contact portion, is thus fused and adhered to the transfer sheet. Thereby, the toner is fixed thereto.

In order to fix the toner image formed on such a transfer material at a high speed by the fixation device with the construction as described above, for example, it is considered to raise a fixing temperature of the fixing member and to shorten a time necessary for the transfer material to pass through the pressure contact portion.

In order to raise the fixing temperature in a short time, it is considered to provide a high power heater in the fixation device, to increase the heater in amount and number, and so on. However, large power consumption is required when it is attempted to raise the fixing temperature in a short time, to increase the number and amount of the heater, and so on. Accordingly, there has been a problem in that, when it is attempted to provide a high speed and high image quality image forming apparatus, it is necessary to increase the power consumption of the entire image forming apparatus.

In this connection, it is necessary to control power consumption of the fixation device under operation in order to restrict the power consumption of the entire image forming apparatus within predetermined power consumption. For example, the following technologies have been proposed. In the first technology, priorities are given to an upper heat roller (a fixing roller) and a lower heat roller (a pressure roller), target temperatures are determined for the individual rollers, the heat roller having higher priority is operated first-based on the target temperature, the heat roller having lower priority is operated during a stop of energization of the heat roller having the higher priority, and both heat rollers are thus alternately operated so as not to be made to turn on simultaneously (for example, refer to JP-Tokukaihei-9-311580A). In the second technology, during a period from transfer of one image to an intermediate transfer body to transfer of the next image thereto, for example, the heat roller of either the fixing roller or the pressure roller is energized, and the two heat rollers are not energized simultaneously (for example, refer to JP-Tokukai-2000-19926A). In the third technology, the two heat rollers are alternately energized at a constant cycle (for example, refer to JP-Tokukai-2004-70056A). Moreover, in the fourth technology, in order to control the power consumption in conjunction with other devices than the fixation device, a dehumidifying heater for the transfer sheet is operated while the energization of the heater of the fixation device is being stopped, and the power consumption of the image forming apparatus is thus to be controlled (for example, refer to JP-Tokukai-2003-58024A).

However, in any of the constructions described in the above conventional technologies, the two heaters were always controlled to be energized based on the preset priorities while the image forming apparatus was being operated.

Specifically, the constructions described in JP-Tokukaihei-9-311580A, JP-Tokukai-2000-19926A, and JP-Tokukai-2003-58024A relate to the energization control for the two heaters in the fixation device, and the construction described in JP-Tokukai-2003-58024A relates to the energization control for the two heaters which are the dehumidifying heater and the heater of the fixation device. In any of the constructions, the priorities are preset for the two heaters, the heater having the higher priority is energized first, and the heater having the lower priority is energized while the energization of the heater having the higher priority is being stopped. In such a way, the control is always made so that the two heaters cannot be energized simultaneously, and the power consumption of the image forming apparatus under operation is thus controlled within the range of the predetermined power consumption.

Accordingly, the number of heaters for which the energization is controlled is increased to three or more, for example, in the case of providing the heaters to the following rollers for the purpose of fixing the toner image formed on the transfer material at the high speed. The rollers are the heat roller which heats the fixing belt of the fixation device, the pressure roller which forms the pressure contact portion abutting on the fixing belt and inserting the transfer material therethrough, an external heat roller provided so as to supply heat to the heat roller by abutting on the pressure roller as its surface temperature is less prone to rise owing to an elastic layer provided on the surface thereof, and the like. Moreover, when the operation state of the image forming apparatus is changed, for example, to warming up (WU), immediately after the start of paper feeding, under paper feeding, and standby, and in the case where it is required to perform the energization control for the heaters so as to make it possible to perform the optimum temperature control for the fixation device, which corresponds to the respective operation states, the heaters each having higher priority, for which it is necessary to preferentially perform the energization, are different depending on the respective operation states. Hence, there has been a problem in that it is impossible to perform the optimum temperature control for the fixation device in response to the operation state of the image forming apparatus within the range of the predetermined power consumption only by always making the control based on the preset priorities to avoid simultaneous energization of the two heaters.

SUMMARY OF THE INVENTION

The present invention has been made in consideration of the above-described circumstances. It is an object of the present invention to provide an image forming apparatus capable performing the optimum temperature control for the fixation device within the range of the predetermined power consumption, and capable of forming high-quality images free from an occurrence of a fixation defect and the like.

In order to solve the above-described problem, according to a first aspect of the present invention, An image forming apparatus, comprises:

a fixation device comprising a plurality of heaters; and a control unit which performs energization control for the plurality of heaters, wherein any one of at least three priorities which are first, second and third priorities for energizing the plurality of heaters so that power consumptions of the heaters does not exceed a predetermined total power consumption is given to each of the plurality of heaters in response to an operation state of the image forming apparatus, and the control unit performs the energization control for the heaters to which the first priority and the second priority are given when the image forming apparatus is in the operation state, does not energize the heater to which the third priority is given while the heater to which the second priority is given is energized, and performs the energization control for the heater to which the third priority is given while the heater to which the second priority is given is not energized.

In accordance with the first aspect of the present invention, the operation state of the image forming apparatus is classified into the plurality of operation states, and any one of at least the three priorities which are the first, second and third priorities for energizing the plurality of heaters so that the power consumptions thereof cannot exceed the predetermined total power consumption is given to each of the plurality of heaters in response to the operation state of the image forming apparatus. Accordingly, the control unit performs the energization control for the heaters based on these priorities in response to the operation state, thus making it possible to perform the optimum temperature control for the fixation device in the image forming apparatus within a range of the predetermined power consumption in response to the operation state, and to provide an image forming apparatus which can form a high-quality image free from a fixation defect and the like.

It is preferable that the priorities be given to the heaters in response to the operation state of the image forming apparatus and thickness of a transfer material.

In accordance with this invention, it is possible for the fixation device to perform the fixation for transfer materials different in thickness. It is preferable that any one of at least the three priorities which are the first, second and third priorities for energizing the plurality of heaters so that the power consumptions thereof cannot exceed the predetermined total power consumption be given to each of the plurality of heaters in response to the operation state of the image forming apparatus and the thickness of the transfer material. In particular, in the case of using plain paper and thick paper as the transfer materials different in thickness, any one of at least the three priorities which are the first, second and third priorities for energizing the plurality of heaters so that the power consumptions thereof cannot exceed the predetermined total power consumption is given to each of the plurality of heaters in response to the operation state of the image forming apparatus and the thickness of the transfer material, and accordingly, stable fixing temperature can be obtained irrespective of the thickness of the transfer material, and the image forming apparatus which can form the high-quality image free from the fixation defect and the like can be provided.

Moreover, it is preferable that the power consumption of the heater to which the second priority is given and the power consumption of the heater to which the third priority is given be set to be substantially equal to each other.

In accordance with this invention, the power consumption of the heater to which the second priority is given and the power consumption of the heater to which the third priority is given are set to be substantially equal to each other. Accordingly, even if priorities of the heater to which the second priority is given and the heater to which the third priority is given are changed for each operation state, it is made possible to perform an efficient energization control within the range of the predetermined power consumption.

Moreover, it is preferable that the operation state is a series of operation states from turning on of a power supply of the image forming apparatus through image formation based on image information inputted to the image forming apparatus to shutting of the power supply, and is classified according to individually preset conditions into at least four operation states which are a state of warming up, a state of immediately after start of paper feeding, a state under paper feeding, and a standby state, the state of the warming up being one that the power supply is turned on and a predetermined member of the image forming apparatus reaches a predetermined temperature, the state of immediately after start of paper feeding being from execution of the image formation after the state of the warming up and the start of the feeding of a transfer sheet on which an image is first formed to an elapse of a predetermined time or to completion of feeding of a predetermined number of sheets, or from the start of the feeding of the transfer sheet to recovery of temperature of the fixation device, the temperature having dropped owing to heat absorption of the fed transfer sheet, to a predetermined temperature, the state under paper feeding being one that the transfer sheets on which the image is continuously formed after the state of immediately after start of the paper feeding are fed to the fixation device, and the standby state being of waiting for the input of the image information after the state of the warming up or the state under paper feeding.

According to this invention, a series of the operation states from the turning on of the power supply of the image forming apparatus through the image formation based on the image information inputted to the image forming appratus to the shutting of the power supply is classified according to the individually preset conditions into, for example, four operation states which are the state of the warming up, the state of immediately after the start of the paper feeding, the state under paper feeding, and the standby state. Accordingly, the optimum priority can be set for each heater in response to the operation state, and the control unit can perform the efficient energization control within the range of the predetermined power consumption in response to the operation state.

Moreover, it is preferable that the fixation device include a fixing belt, a fixing roller, a heat roller which heats the fixing roller through the fixing belt, a pressure roller which comes into pressure contact with the fixing roller through the fixing belt, and an external heat roller which abuts on the pressure roller, and that the heaters be provided in the heat roller, the pressure roller, and the external heat roller.

Furthermore, it is preferable that three or more of the heaters be provided in the heat roller.

According to this invention, the heaters are provided in the heat roller, pressure roller, and external heat roller of the fixation device including the heat roller, the fixing belt, the fixing roller, the pressure roller, the external heat roller, and the like, and in addition, three or more heaters are provided in the heat roller. In such a way, an appropriate energization control can be individually performed also in the case of using the plain paper and the thick paper as the transfer materials different in thickness. Moreover, a radical drop of the fixing temperature immediately after the start of the paper feeding can be controlled, and the toner image on the transfer material can be fixed appropriately. Accordingly, the image forming apparatus which can form the high-quality image free from the fixation defect and the like can be provided.

DETAILED DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIG. 2B is a specification table showing specifications of the fixation device, in which fixation of an unfixed toner image to plain paper is regarded as important;

FIG. 2C is a specification table showing specifications of the fixation device, in which fixation of the unfixed toner image to thick paper is regarded as important;

FIG. 2D is a specification table showing specifications of a conventional fixation device, which is shown as Comparative example;

PREFERRED EMBODIMENT OF THE INVENTION

Figure 1:
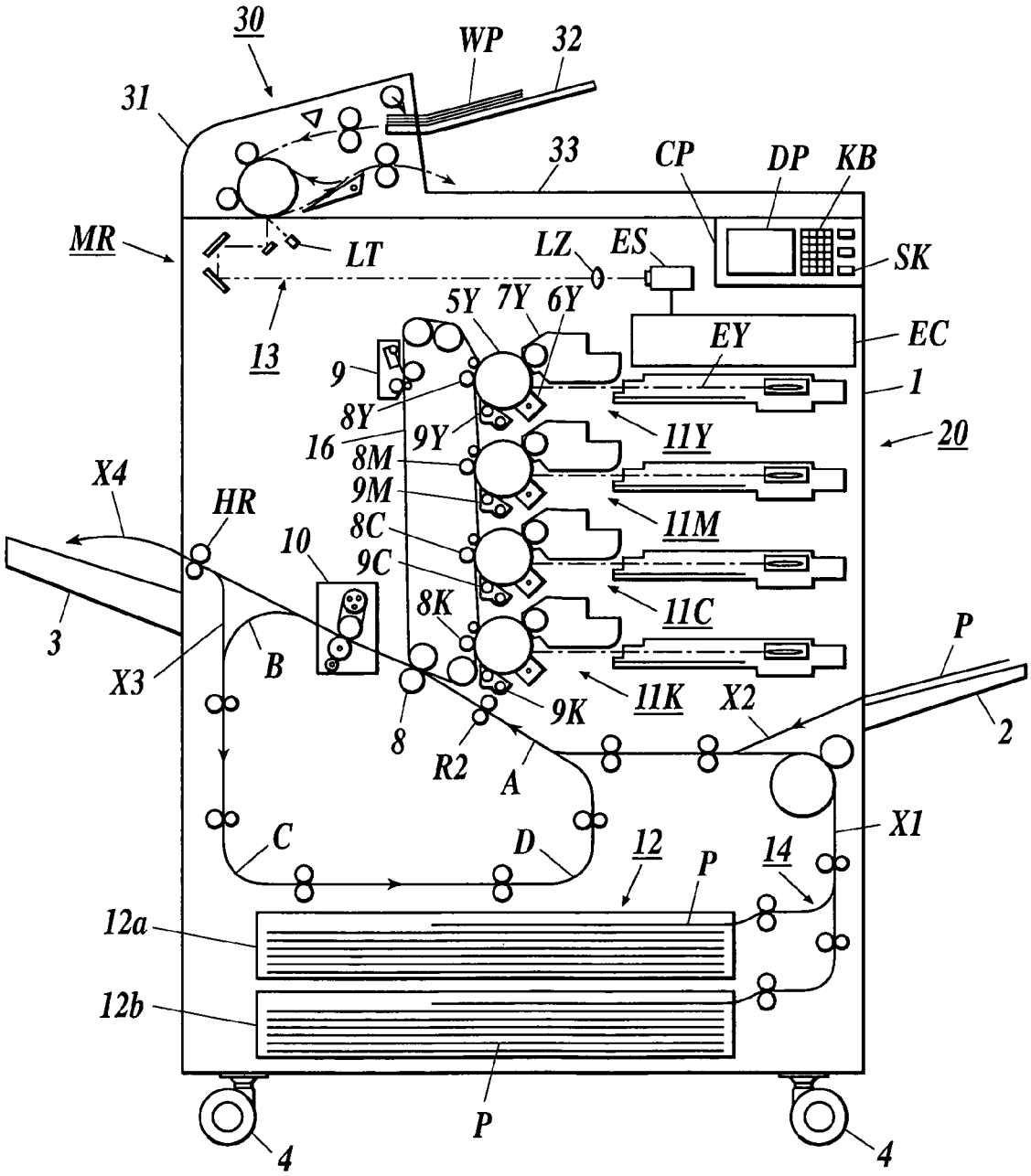
FIG. 1 is a schematic view of an image forming apparatus according to the present invention.

The present invention will be described in detail below while referring to the drawings; however, the present invention is not limited to this. Note that the same reference numerals and symbols denote the same objects in the respective drawings, and the description will be made in detail with reference to the other related drawings as appropriate.

Figure 2A:
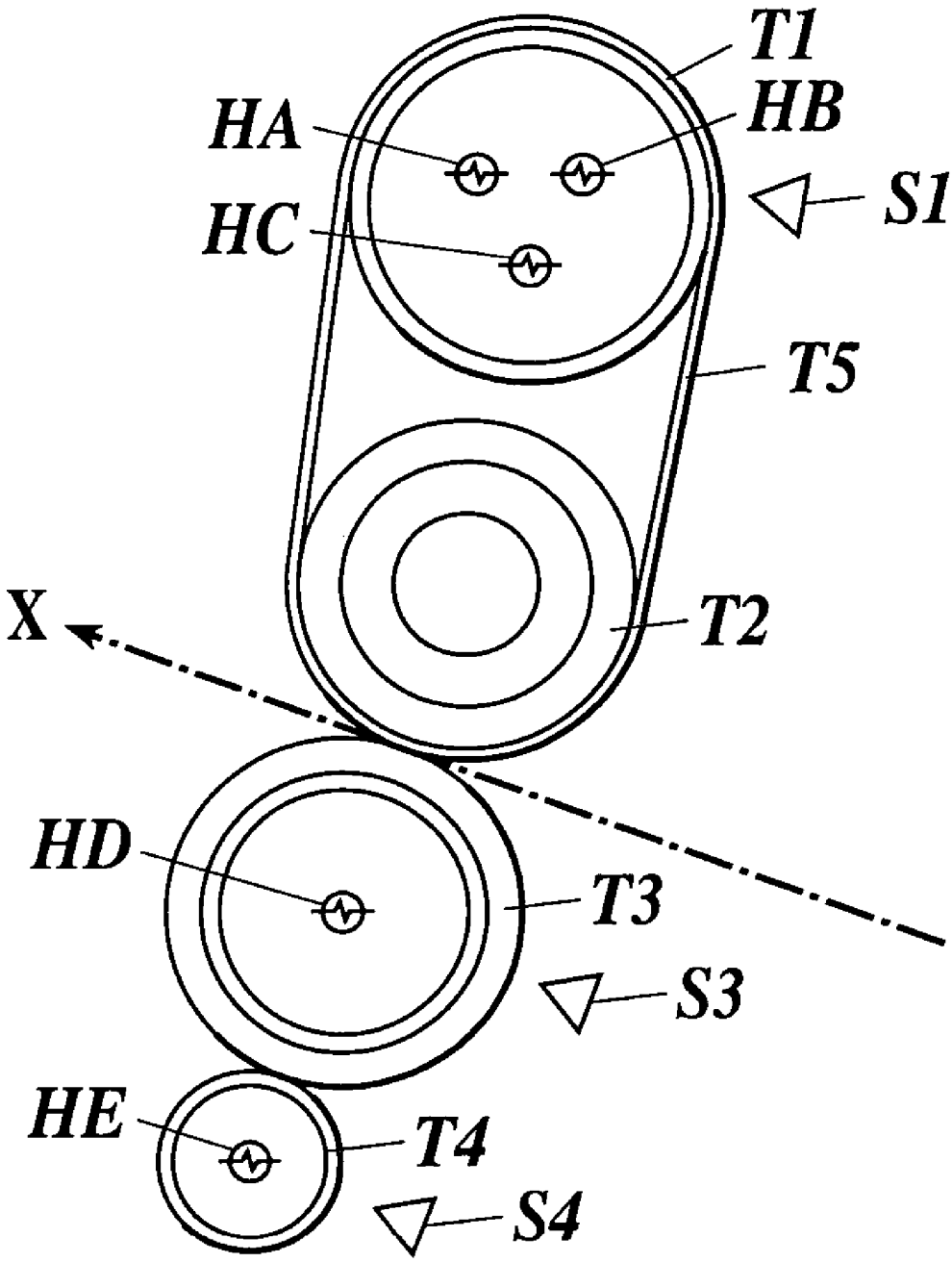
FIG. 2A is a first construction view of a fixation device according to the present invention.
Figure 3:
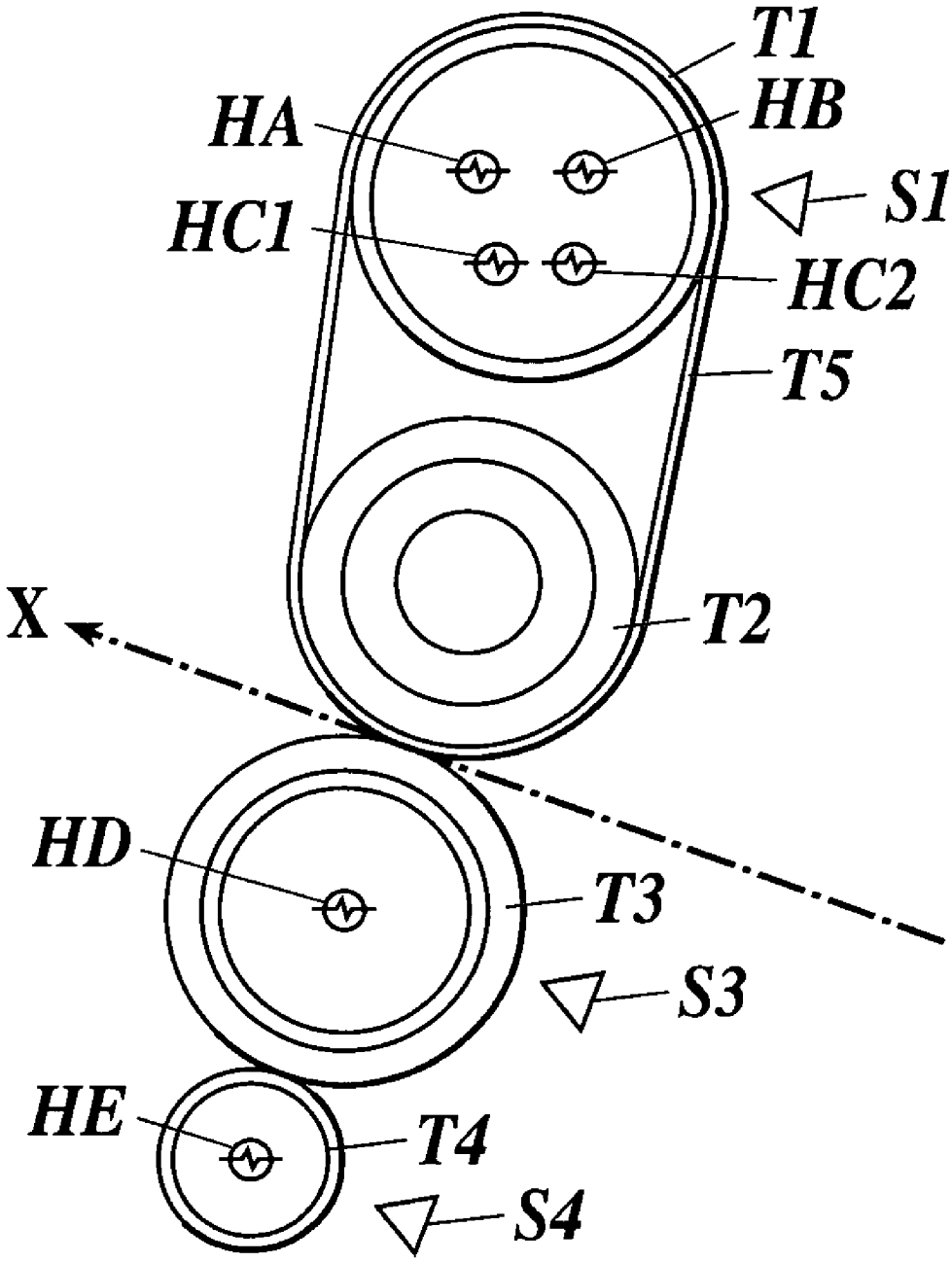
FIG. 3 is a second construction view of the fixation device according to the present invention.
Figure 4:
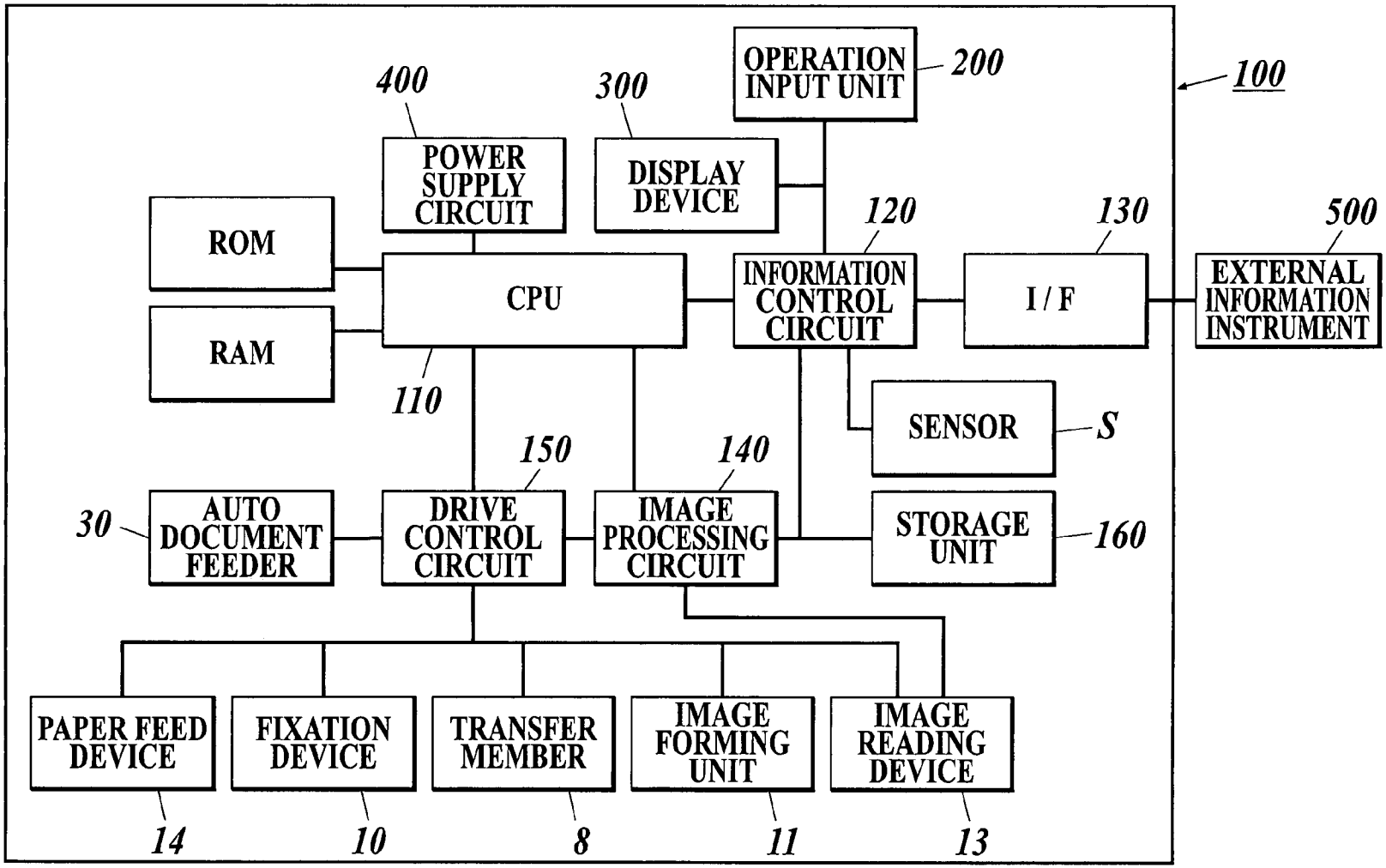
FIG. 4 is a block diagram showing a circuit configuration of the image forming apparatus according to the present invention.
Figure 5:
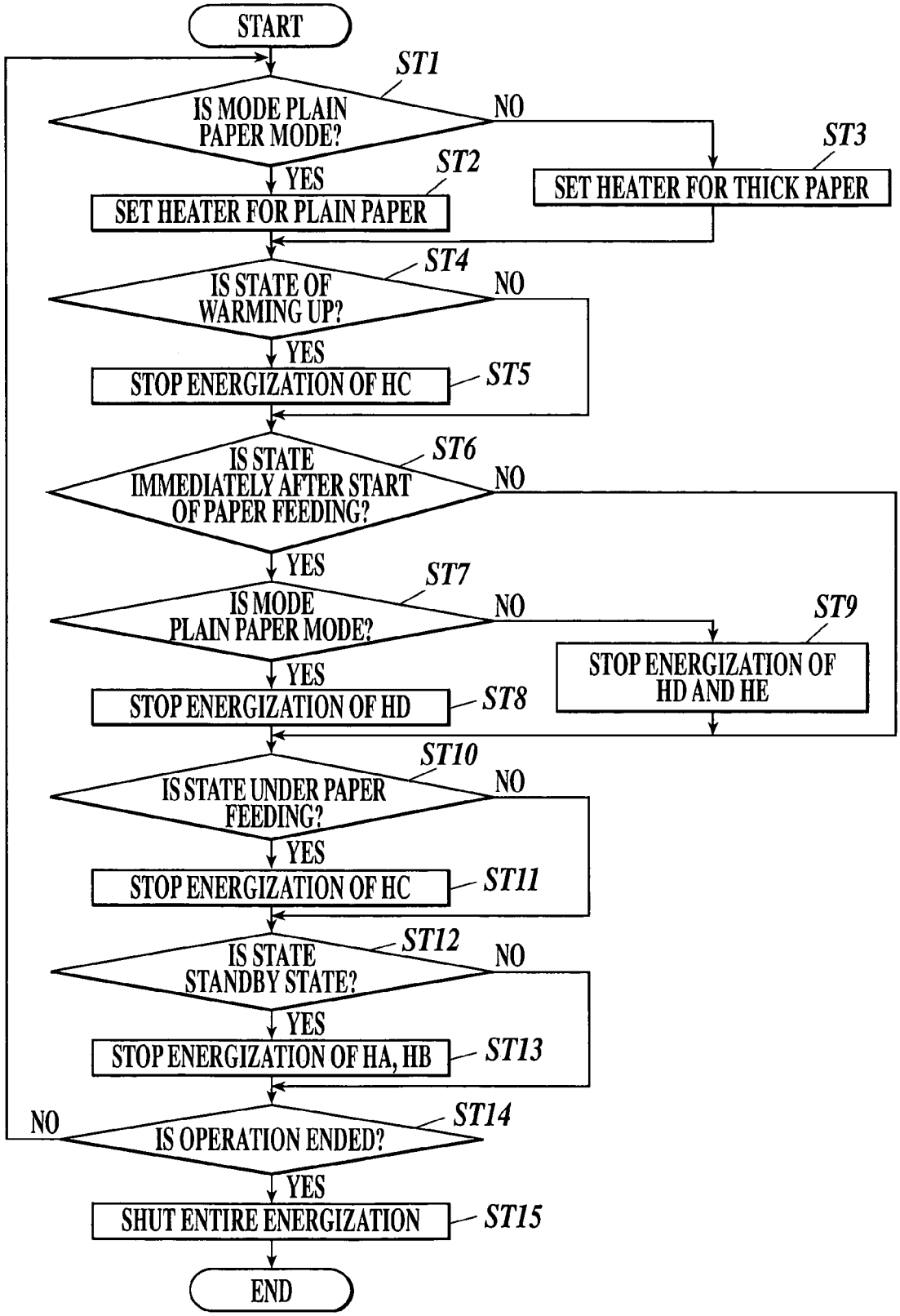
FIG. 5 is a flowchart for explaining energization control for the fixation device according to the present invention.
Figure 6:
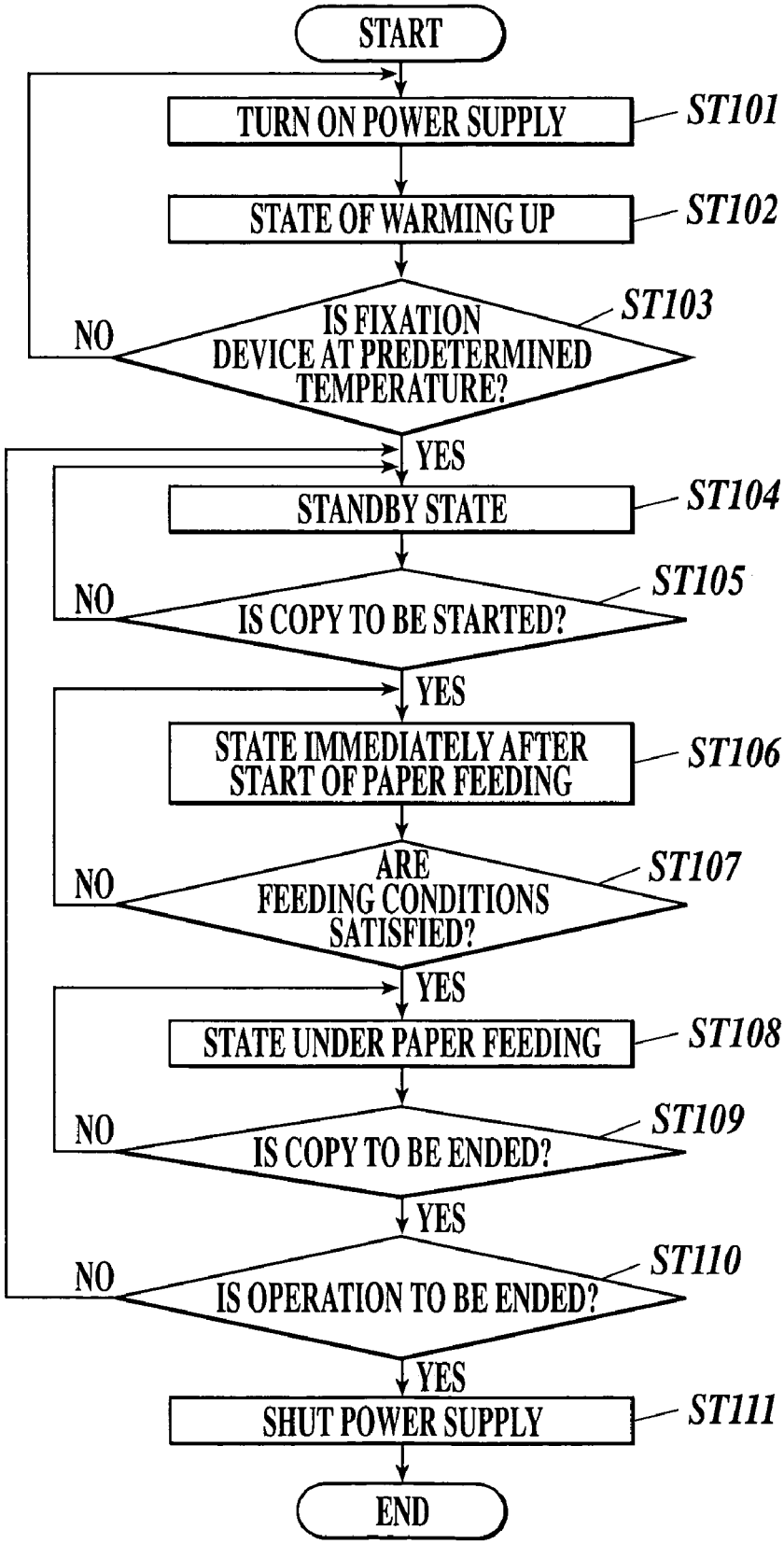
FIG. 6 is a flowchart for explaining an operation state of the image forming apparatus according to the present invention.
Figure 7A:
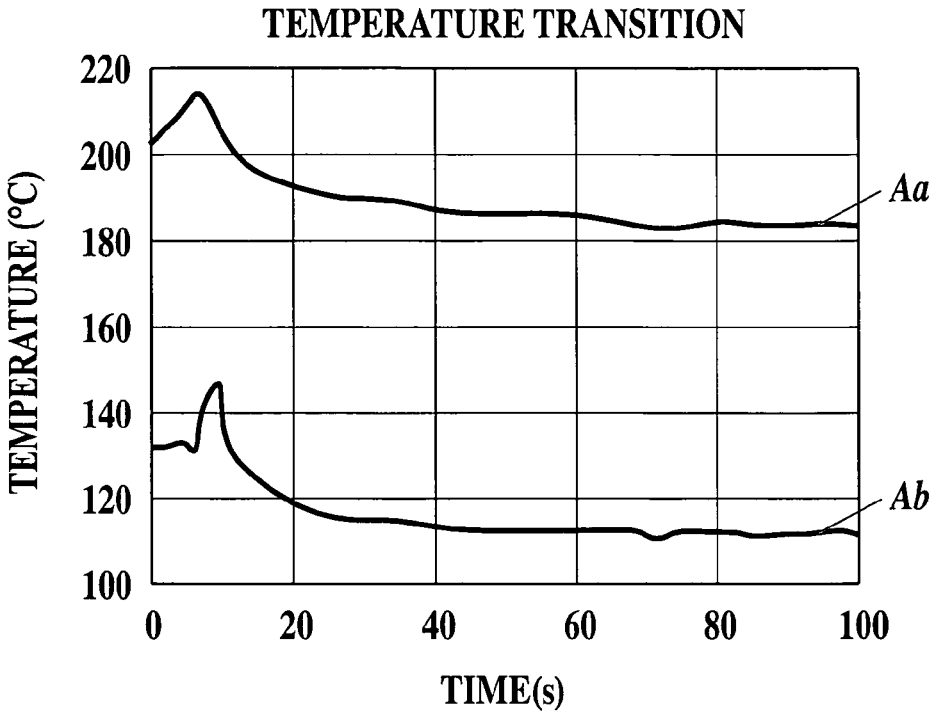
FIG. 7A is a graph showing Comparative example of the energization control for the fixation device according to the present invention.
Figure 7B:
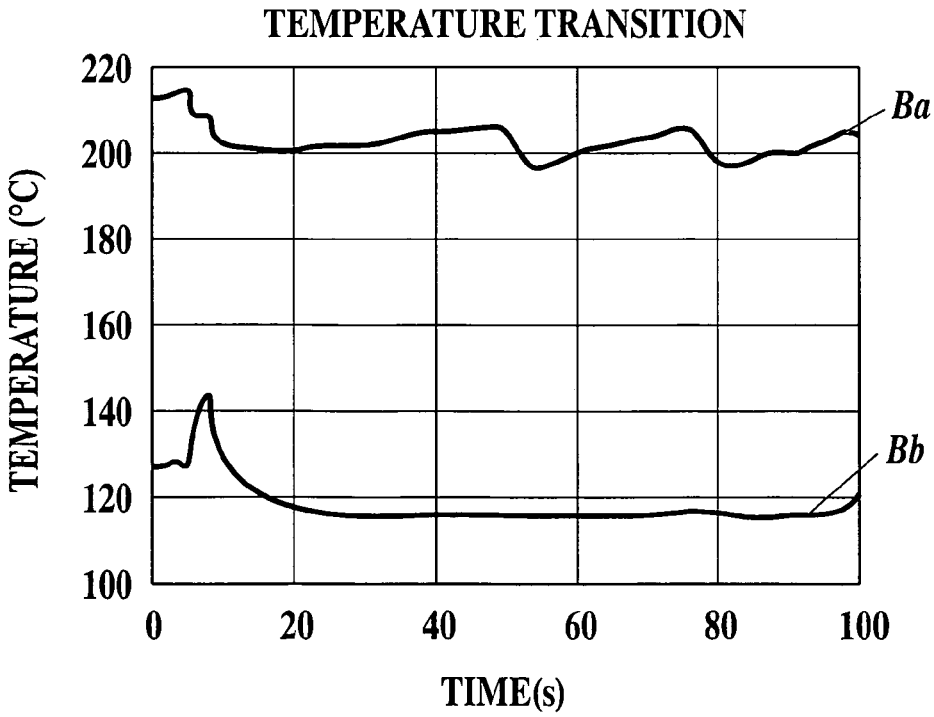
FIG. 7B is a graph showing Example of the energization control for the fixation device according to the present invention.

FIG. 1 is a schematic view of an image forming apparatus according to the present invention. FIG. 2A is a first construction view of a fixation device according to the present invention. FIG. 2B is a specification table showing specifications of the fixation device, in which fixation of an unfixed toner image to plain paper is regarded as important. FIG. 2C is a specification table showing specifications of the fixation device, in which fixation of the unfixed toner image to thick paper is regarded as important. FIG. 2D is a specification table showing specifications of a conventional fixation device, which is shown as Comparative example. FIG. 3 is a second construction view of the fixation device according to the present invention. FIG. 4 is a block diagram showing a circuit configuration of the image forming apparatus according to the present invention. FIG. 5 is a flowchart for explaining energization control for the fixation device according to the present invention. FIG. 6 is a flowchart for explaining operation state of the image forming apparatus according to the present invention. FIG. 7A is a graph showing Comparison example of the energization control for the fixation device according to the present invention. FIG. 7B is a graph showing Example of the energization control for the fixation device according to the present invention.

A construction of the image forming apparatus according to the present invention will be described with reference to FIG. 1.

For the purpose of simplifying the explanation, an image forming apparatus 20 in the embodiment of the present invention is assumed to be a copier of an electrophotographic system. Since the copier of the electrophotographic system is well known, portions which are not directly related to the present invention will be briefly described.

Reference numeral 20 denotes the image forming apparatus, and reference numeral 30 denotes an auto document feeder (ADF) attached to the image forming apparatus 20.

In the image forming apparatus 20, a manual bypass tray 2 for supplying relatively few pieces of transfer materials P is provided on the right face of a cabinet 1, and a paper receiving tray 3 is provided on the left face thereof.

The transfer materials P which are supplied from a paper feed cassette 12 to be described later and the manual bypass tray 2 and have images formed thereon are discharged to the paper receiving tray 3, and are stacked thereon.

Note that, though the transfer materials P include regular transfer sheets made of plain paper, and special transfer sheets made of OHP sheets, it is assumed in the embodiment of the present invention that the regular transfer sheets (also simply referred to as transfer sheets P) made of the plain paper are used unless particularly specified.

On the bottom of the cabinet 1, a plurality of rollers (also referred to as casters) 4 for making it possible to move the image forming apparatus 20 are provided.

On an upper portion of a front face of the cabinet 1, a control panel CP is provided as a display device and an operation input unit for operating the image forming apparatus 20.

The control panel CP includes a liquid crystal display device as a display device DP, and a liquid crystal display device of a touch-panel system, in which a touch panel and the like are incorporated.

Moreover, for the purpose of inputting control related information including various image formation conditions as to whether the image forming is to be performed colorfully or monochromatically, the number of image-formed sheets, the number of copies, and the like, there is provided an operation input unit comprising a keyboard KB for inputting numeric values and the like, a start button SK for executing a series of image forming steps, and the like.

In particular, the display device DP of the touch-panel system is made to be capable of inputting selection, setting, and the like of information displayed on the display unit when a user touches a pattern of a button or the like displayed on the display unit, on which a numeric character, a literal character, a symbol, or the like is drawn. For example, the display device DP also serves as an input unit for items for which selection and setting of an operation mode are required, the operation mode including a simplex mode, a duplex mode, and the like.

Note that the simplex mode refers to a simplex mode of transferring a toner image, which is formed by an image forming unit 11 based on image data, only to one surface of each transfer sheet P, and forming the image thereon. Incidentally, the duplex mode is a duplex mode of forming images on both surfaces of each transfer sheet.

In an inside of the cabinet 1, there are provided a control unit EC, transfer members 8, a fixation device 10, the image forming unit 11, an image reading device 13, a paper feed device 14, an intermediate transfer body 16, and the like.

The control unit EC is also called a control circuit, which controls the entire operations of the image forming apparatus 20. The control unit EC comprises an electric circuit formed of a CPU (central processing unit) a ROM, a RAM, and the like. The control unit EC controls drives of all the members constructing the image forming apparatus 20 based on a control program, control data, and the like, prestored in the ROM.

Moreover, when an accompanying device such as the auto document feeder 30 is connected to the image forming apparatus 20, the control unit EC controls the drives of all the members in a similar way to the above so as to allow the members to operate smoothly as a system of the image forming apparatus 20 in cooperation with such an accompanying device.

Furthermore, when the image forming apparatus 20 is connected to a personal computer or other information instruments through a local area network (LAN) or the like, the control unit EC can also control the drives, which include storage and delivery of the information necessary for the operation, smoothly without any trouble in cooperation with the personal computer or the like.

The image forming unit 11 forms an image based on image information of an original or the like. The image formation in the embodiment is called a tandem system, where an image forming unit 11Y which forms a yellow (Y) image, an image forming unit 11M which forms a magenta (M) image, an image forming unit 11C which forms a cyan (C) image, and an image forming unit 11K which forms a black (K) image are arranged in this order in the vertical direction from an upper portion of the image forming apparatus 20 to a lower portion thereof.

The image forming units 11Y, 11M, 11C and 11K perform the same operation except that colors of toners for use are different from one another. Accordingly, a description will be made here in detail only of the image forming unit 11Y which forms the yellow (Y) image by assigning reference numeral thereto.

The image forming unit 11Y comprises, for example, a photosensitive drum 5Y which rotates in a preset imagery direction (for example, the counterclockwise direction) by a driving source, such as a motor, a charging device 6Y which uniformly charges the photosensitive drum 5Y, an exposure device EY which forms, on the photosensitive drum 5Y, an electrostatic latent image formed of signals based on the image information (also referred to as image data) of the original, a developing device 7Y which allows the electrostatic latent image formed on the photosensitive drum 5Y to emerge as the toner image, a transfer member (also referred to as a primary transfer member) 8Y which transfers the toner image formed on the photosensitive drum 5Y to the intermediate transfer body 16, a cleaning device 9Y for scraping off the toner, paper dust, and the like remaining on the photosensitive drum 5Y after the toner image is transferred to the intermediate transfer body 16, and the like.

The toner images formed on the respective image forming units are sequentially transferred to the belt-like intermediate transfer body (also referred to as a transfer belt) 16 which rotates, for example, in the clockwise direction, and are then superposed on one another.

The toner images of the respective colors, which are transferred to the intermediate transfer body 16, are transferred to each transfer sheet P from the intermediate transfer body 16 by electrostatic force in such a manner that charges reverse in polarity to the toner images are imparted to the transfer sheet P by transfer rollers 8 as the transfer members.

To the transfer sheet P on which the toner images are transferred, the toner images are fixed by being fused and adhered in a process where the transfer sheet P passes through the fixation device 10. Thereafter, the transfer sheet P on which a color image made of the toners of Y, M, C, and K is formed is discharged to the paper receiving tray 3.

Note that, as described in this embodiment, the image forming apparatus using the intermediate transfer body can superpose the toner images formed by the respective image forming units on one another on the intermediate transfer body, and thus is widely used for a color image forming apparatus. Moreover, the intermediate transfer body is not limited to the belt shape and may be a drum shape if it is possible for the intermediate transfer body to transfer the toner images formed by the image forming units.

In this embodiment, each of the transfer members 8 comprises, for example, a transfer roller according to a contact transfer system, and is disposed at a transfer position opposite to the intermediate transfer body 16. The transfer members 8 transfer the toner images formed on the intermediate transfer member 16 to the transfer sheet P by means of the electrostatic force by imparting thereto the charges reverse in polarity to the toner images.

Note that the transfer members 8Y, 8M, 8C and 8K are the transfer members which have similar constructions and are used for transferring the toner images formed by the image forming units 11Y, 11M, 11C and 11K to the intermediate transfer body 16.

Each of the cleaning devices 9 removes the toner, the paper dust, and the like which remain on the intermediate transfer body 16, and comprises a blade, a brush roller, or the like. The cleaning devices 9Y, 9M, 9C and 9K are the cleaning devices which have similar constructions and are used for cleaning the photosensitive drums of the image forming units 11Y, 11M, 11C and 11K.

Although details will be described later, the fixation device 10 comprises, for example, a fixing belt brought into press contact with unfixed toner images, a heat roller and a pressure roller, each incorporating a heater therein, an external heat roller, and the like. The fixation device 10 fixes the toner images transferred to the transfer sheet P by fusing and adhering the toner images concerned thereon by means of heat, pressure, and the like.

The image reading device 13 comprises an optical reading system formed of a light source LT, a mirror group MR, an imaging lens LZ, and the like, and comprises a reading device ES formed of an electric circuit including a solid-state imaging element (charge coupled device: CCD), and the like.

The reading device ES reads image information of an original mounted on a platen glass (not shown) provided on an upper portion of the cabinet 1, and of an original fed to a reading position by the auto document feeder 30, converts the image information into image data, and stores the image data in a storage unit provided in the control unit EC.

Moreover, in the case of reading, by the image reading device 13, the original fed by the auto document feeder 30, the light source LT irradiates the original fed to the reading position, and through the mirror group MR, reflected light from the original is formed into an image on a surface of the CCD of the reading device ES by the imaging lens LZ. Then, image information outputted from the CCD is stored as image data.

The paper feed device 14 comprises the paper feed cassette 12, a motor as a driving source, a plurality of rollers, and the like.

The paper feed cassette 12 comprises, for example, a cassette 12*a* which houses special transfer paper, and a cassette 12*b* which houses the plain paper.

After selecting the special transfer paper or the plain paper according to an instruction of the control unit EC, the paper feed device 14 rotates the motor as the driving source, thereby rotationally driving the group of rollers. In such a way, the paper feed device 14 feeds and coveys the selected paper from the paper feed cassette 12 toward the intermediate transfer body 16 at appropriate timing, and discharges and conveys the paper to the paper receiving tray 3 after an image is formed on the paper in such a manner that the toner image is fixed thereto by being fused and adhered by means of the fixation device 10.

Note that the paper feed device 14 includes a feed passage X1 which feeds the transfer sheet P from the paper feed cassette 12 toward resist rollers R2, a feed passage X2 which feeds the transfer sheet P from the manual bypass tray toward the resist rollers R2, and a feed passage X4 which feeds the transfer sheet P from discharge rollers HR toward the paper receiving tray 3. In addition, the paper feed device 14 includes a feed passage X3 which discharges the transfer sheet P to the paper receiving tray 3, for example, while turning an image-formed surface of the transfer sheet P to a backside or a front side (which is also referred to as "face down" or "face up"), circulation feed passages A to D which inverts the transfer sheet P in the duplex mode or the like, and the like. Details of the feed passage X3 and the circulation feed passages A to D are omitted.

The intermediate transfer body 16 is also called the transfer belt, and comprises a belt-like object extended among the plurality of rollers. In this embodiment, the intermediate transfer body 16 rotates in the clockwise direction by a driving source (not shown) such as a motor.

Note that, in the case of using the intermediate transfer body, it is desirable to variously select and employ electrical characteristics such as volume resistivity and surface resistivity, a layer construction, a material, material property, and the like for the intermediate transfer body, according to the image formation conditions and the like.

In the auto document feeder 30, the entire feed device thereof is covered with an ADF cabinet 31, and outside of the ADF cabinet 31, an original mount stage 32 and an original receiving tray 33 are provided.

On the original mount stage 32, a plurality of originals WP set in a state where the surface of the original of the first page is situated to be the uppermost are mounted. The originals WP thus mounted are fed to the reading position by an original feed device comprises a plurality of rollers and the like, read by the reading device ES, and discharged to the receiving tray 33.

The original feed device is operated by a drive control circuit (not shown) in conjunction with the control unit EC of the image forming apparatus 20.

Next, the fixation device will be described with reference to FIGS. 2A to 2D.

FIGS. 2A to 2D are construction views of the fixation device in this embodiment: FIG. 2A is the schematic view of the fixation device; FIG. 2B is the specification table showing the specifications of the fixation device, in which the fixation of the unfixed toner image to the plain paper is regarded as important; FIG. 2C is the specification table showing the specifications of the fixation device, in which the fixation of the unfixed toner image to the thick paper is regarded as important; and FIG. 2D is the specification table showing the specifications of the conventional fixation device, which is shown as Comparative example.

In FIG. 2A, reference symbol T1 denotes the heat roller which incorporates, as heaters, two main heaters HA and HB and an auxiliary heater HC therein, reference symbol T2 denotes a fixing roller, reference symbol T3 denotes the pressure roller which incorporates a heater HD therein, reference symbol T4 denotes the external heat roller which incorporates a heater HE therein, reference numeral T5 denotes the fixing belt, reference symbol S1 denotes a temperature sensor for the heat roller, reference symbol S3 denotes a temperature sensor for the pressure roller, and reference symbol S4 denotes a temperature sensor for the external heat roller.

When the fixing roller T2 and the pressure roller T3 are brought into pressure contact with each other through the fixing belt T5, the transfer sheet (not shown) to which the toner image is transferred is inserted into a pressure contact portion formed of the fixing belt T5 and the pressure roller T3. Then, the transfer sheet is heated and pressurized, and then passes through the pressure contact portion in a direction of an arrow X. In such a way, the toner image is fixed to the transfer sheet.

In this embodiment, an aluminum-made cylindrical body excellent in thermal conductivity is basically used as a base material of each of the rollers, and a surface layer of each roller is formed of a tube made of PFA (registered trademark), formed by coating the PFA thereon, and so on. In particular, in each of the fixing roller T2 and the pressure roller T3, on an outer layer of the base material thereof, an elastic layer made of silicon rubber, a sponge, or the like is provided, and the surface layer is provide on the elastic layer.

Moreover, in the fixing belt T5, for example, an elastic layer formed of silicon rubber or the like is provided on a base material formed of a polyimide film, and such a PFA (registered trademark) tube or the like is used as a surface layer of the fixing belt T5.

Note that the PFA (registered trademark) is one of Teflon (registered trademark) resins made by US Dupont Corporation, and refers to perfluoroalkoxy resin having property, for example, a continuous duty temperature of 260° C.

General halogen lamps are used as the heaters. In the heat rollers T1, there are provided the halogen lamps HA and HB of which light distributions are different from each other in order to handle sheets with different sizes, and the halogen lamp HC of which light distribution is substantially flat and uniform. The halogen lamp HC is disposed in order to maintain temperature of the fixing members such as the rollers of the fixation device in a standby state where the image formation is not performed, and to assist the supply of heat immediately after the start of paper feeding.

Total power consumption usable in these heaters is obtained as follows: power to be used for forming the toner image based on the image information, feeding and discharging the transfer sheet, and post-processing of other output operations is subtracted from power supplied from the main body of the image forming apparatus. In this embodiment, it is possible to supply 3 kW to the main body of the image forming apparatus, and a little less than 1 kW is used therefrom for the drive control for the devices other than the fixation device. Accordingly, affording some margin, 2 kW is allocated as the power (consumption power) for the heaters of the fixation device.

The image forming apparatus sets a range of basis weight of usable paper based on performance of the transfer device and fixation device thereof. However, a user assumed by the image forming apparatus concerned sometimes desires that the image forming apparatus handle thicker paper and different paper. FIG. 2B shows a construction suitable for the case of using the image forming apparatus for usual office work. Specifically, the construction is made, in which the temperature of the pressure roller is maintained as high as possible, and a temperature difference between the fixing belt and the pressure roller is reduced, thereby restricting, to the minimum possible, paper curl after the fixation, which significantly occurs in the plain paper for use in usual office work.

In small printing, coated paper in which a coating layer is provided on a surface layer is used as a standard, and it is required that the image forming apparatus can fix the toner image to such coated paper having larger basis weight than the paper for use in the office work. The coated paper has a less amount of curl occurring owing to the temperature difference between the fixing belt and the pressure roller. Accordingly, it is desirable that the fixation device be constructed so that the temperature of the fixing belt side cannot drop even for the large basis weight by increasing the heat supply to the fixing belt side even if the temperature of the pressure roller drops to some extent. It is FIG. 2C that shows the construction described above. Larger power is supplied to the fixing belt side, and accordingly, it is made possible to fix the toner image even to the thick paper.

Note that the basis weight is represented by a mass per predetermined area, and expressed in a unit of ($kg/m^2$).

Note that the temperature sensor S1 for the heat roller is a sensor for detecting a surface temperature of the fixing belt T5, outputting temperature information thereof, and controlling the heaters HA, HB and HC incorporated in the heat roller by the control circuit. Moreover, the temperature sensor S3 for the pressure roller is a sensor for detecting a surface temperature of the pressure roller T3, outputting temperature information thereof, and controlling the heater HD incorporated in the pressure roller by the control circuit. Furthermore, the temperature sensor S4 is a sensor for controlling the heater HE incorporated in the external heat roller T4 in a similar way.

An operation of the fixation device in this embodiment will be briefly described.

For example, the pressure roller T3 is rotated by the driving source (not shown) such as the motor. In such a way, the heat roller T1 is rotated through the fixing belt T5, and the heat of the heaters HA, HB and HC incorporated in the heat roller T1 is conducted to the fixing belt T1. The heat roller T3 is also heated by the heater HD incorporated therein. Moreover, the external heat roller T4 which abuts on the pressure roller T3 also rotates following the pressure roller T3, and the heat of the heater HE incorporated in the external heat roller T4 is conducted to the pressure roller T3.

When the transfer sheet P to which the toner image is transferred is inserted into the pressure contact portion formed of the pressure roller T2 and the pressure roller T3 brought into press contact therewith through the fixing belt T5, the toner image is fixed by the heating and pressurization of the pressure contact portion.

Moreover, though details will be described later, the respective heaters are controlled to be energized according to the priorities set in response to the operation states by the control circuit as the control unit. For example, the surface temperature of the fixing belt T5 on the heat roller T1 and the surface temperature of the pressure roller T3 are detected by the temperature sensors S1 and S3. When it is determined that the detected temperatures have exceeded the respective preset temperatures, the energization of the respective heaters is stopped. Meanwhile, when it is determined that the detected temperatures become lower than the preset temperatures, the respective heaters are energized.

Next, energization control for the heaters according to the present invention will be described with reference to FIG. 2B and FIG. 2C.

The energization control for the heaters according to the present invention is performed in the following manner. In the energization control, the respective heaters are energized efficiently to perform the heating operations based on the priorities set in response to the operation state of the image forming apparatus within a range of preset allowable power consumption, and fixing temperature obtained by these heaters is controlled at temperatures suitable for the respective operation states. Note that, here, the temperature of the pressure contact portion, which is obtained from the respective heaters and is related to the fixation, is particularly referred to as the fixing temperature.

FIG. 2B and FIG. 2C sequentially show the operation states in left-end vertical fields, showing, for example, that the operation state of the image forming apparatus is classified into four operation states, which are: of warming up (WU); immediately after the start of the paper feeding; under paper feeding; and on standby. Moreover, in the lateral direction in FIGS. 2B and 2C, the heaters HA to HE as the heaters are shown by symbols A to E from which H is omitted. Moreover, the power consumptions of the respective heaters are described as stated earlier.

Note that the state of the warming up (WU) in the operation state refers to an operation state, for example, where each heater is energized to raise the fixing temperature to a predetermined temperature by turning on a power supply of the image forming apparatus, and reaches a state of enabling the image formation.

The state immediately after the start of the paper feeding is a state, for example, where the transfer sheets to which the toner image is transferred are continuously inserted into the fixation device, and the fixing temperature of the pressure contact portion thus drops radically owing to heat absorption by the transfer sheet. The state immediately after the start of the paper feeding refers to an initial fixing operation state in the state under paper feeding, which will be described later.

Variations occur in the above-described temperature drop state, an occurrence period thereof, and the like depending on a function, performance, and the like of the fixation device. Accordingly, it is preferable to preset conditions of the state immediately after the start of the paper feeding for each fixation device, for example, as a period of an elapse of a predetermined time from the start of the fixation, or as a period until the end of the fixation of a predetermined number of sheets.

The state under paper feeding refers to a state where the fixing temperature recovers from the state where the fixing temperature radically drops immediately after the start of the paper feeding, and for example, the image formation is performed in a state where the fixing temperature is stable.

The state on standby refers to a state where there is no input of the image information, for example, where the image formation is not performed for a predetermined period of time while the respective members of the fixation device, which have the heaters, such as the heat roller T1, pressure roller T3, and external heat roller T4 of the fixation device, are maintaining the predetermined temperatures.

Moreover, in lateral fields of FIG. 2B and FIG. 2C, symbols ◎, ○, Δ, and × are filled so as to individually correspond to the heaters HA to HE for each of the above-described operation states. These symbols represent the priorities of the heaters for which the energization control is performed.

Specifically, the symbol ◎ represents the heater energized first, to which the first priority is given. The symbol ○ represents the heater energized next, to which the second priority is given. The symbol Δ represents the heater to which the third priority is given, and for which the energization control is performed while the energization of the heater to which the second priority is given is being stopped. The symbol × represents the heater which is not energized.

Moreover, as described later, with regard to the heaters to which the first, second and third priorities are given, after the energization thereof is started by the control unit, the energization control is performed therefor based on the surface temperature of the fixation device, which is detected by the sensor S, for example, the surface temperatures of the roller members such as the pressure roller so that the energization thereof can be stopped when the surface temperature exceeds the preset temperature.

Note that a difference between the heater to which the first priority is given and the heater to which the second priority is given is that, depending on whether or not the heater to which the second priority is given is energized, it is determined whether or not the heater to which the third priority is given can be energized. Specifically, while the heater to which the second priority is given is being energized, the energization of the heater to which the third priority is given is stopped irrespective of the temperatures of the pressure roller and the external pressure roller, which are to be maintained by the heater to which the third priority is given. Meanwhile, only when the heater to which the second priority is given is in a non-energized state, the energization of the heater to which the third priority is given is controlled based on the temperatures of the pressure roller and the external pressure roller, which are to be maintained by the heater to which the third priority is given.

Note that right-end fields of FIG. 2B, FIG. 2C and FIG. 2D show the total power consumptions which are the maximum in the respective operation states. In any of the fields of the operation states, it is shown that the total power consumption is controlled to be at 2 kW or less, which is the predetermined power consumption.

FIG. 2D shows an example of the priorities in the conventional energization control having a similar configuration to that of this embodiment in accordance with a similar format to those of FIG. 2B and FIG. 2C. FIG. 2D shows that the priorities represented by the symbols ○ and Δ are not changed in response to the operation states, that is, the priorities given to the heaters HC and HD are fixed.

A description will be made of the energization control in the case of FIG. 2B. In the energization control in the case where the fixing of the unfixed toner image to the plain paper is regarded as important (the case is also referred to as the case of regarding the plain paper as important), in the state of the warming up (WU), the two main heaters HA and HB of the heat roller T1 and the heater HE of the external heat roller T4 are set as the heaters (◎) to which the first priorities are given. Moreover, the heater HD of the pressure roller T3 is set as the heater (○) to which the second priority is given. Furthermore, the auxiliary heater HC of the heat roller T1 is set as the heater (Δ) to which the third priority is given.

Specifically, in the state of the warming up (WU), it is desirable that the processing can be shifted to the image formation soon after the power supply of the image forming apparatus is turned on. As conditions for the above, it is desirable to heat up the entire fixation device to the predetermined fixing temperature within a shortest possible period.

In this connection, the heaters HA, HB, HE and HD are energized in conjunction with that the power supply of the image forming apparatus is turned on, the heat roller T1 is rapidly heated by the two main heaters HA and HB in which amounts of heat are large though the power consumptions are large, and the pressure roller T3 which has the elastic layer and difficulty in raising the surface temperature thereof is heated from the inside thereof by the heater HD. Moreover, the surface of the pressure roller T3 is heated by the heater HE of the external heat roller T4. In this case, the auxiliary heater HC of the heat roller T1 as the heater to which the third priority is given, the third priority being lower than the second priority given to the heater HD of the pressure roller T3, is not energized while the heater HD of the pressure roller T3 is being energized.

In the state immediately after the start of the paper feeding, the priorities of the heaters HC and HD are changed from the priorities thereof in the state of the warming up (WU), the auxiliary heater HC of the heat roller T1 is set as the heater (○) to which the second priority is given, and the heater HD of the pressure roller T3 is set as the heater (Δ) to which the third priority is given.

Specifically, immediately after the start of the paper feeding, the temperature of the pressure roller T1 does not differ to a large extent from the temperature of the surface of the fixing belt T5. Accordingly, the temperature of the fixing belt T5 drops owing to the temperature difference between the pressure roller T1 and the surface of the fixing belt T5, which is caused by that the transfer sheet P takes the heat away. In order to solve the above-described state as soon as possible, it is necessary to rapidly raise the temperature of the heat roller T1 so that the temperature of the fixing belt T5 can reach a predetermined value even if the temperature difference occurs owing to that the transfer sheet P takes the heat away.

Accordingly, the energization control for the heater HD of the pressure roller T3 is stopped, in which heat conduction is slow even if the heater is energized, and an influence on fixation property is smaller in comparison with the fixing belt T5 in terms of the temperature. Then, the priority is put to the energization control for the heater HC.

When the temperature of the pressure roller T3 drops, though less than when the temperature of the fixing belt T5 drops, the fixation property declines, and the amount of curl also increases. Accordingly, it is desirable to control the temperature drop of the pressure roller T3, and this is needless to say.

Moreover, the heater HE is incorporated in the external heat roller T4 which has good thermal conductivity, and the external heat roller T4 concerned is made to abut on the surface of the pressure roller T3. Accordingly, an effect of the energization of the heater HE appears without a time delay, and the heater HE is more efficient than the heater HD incorporated in the pressure roller T3. Therefore, the energization control is also performed for the heater HE immediately after the start of the paper feeding.

During the paper feeding, for example, if a predetermined time elapses from a time immediately after the start of the paper feeding, the temperature of the heat roller T2 rises until a temperature gradient necessary for the predetermined temperature of the surface of the fixing belt T5 is obtained, and accordingly, the temperature of the heat roller T1 can be maintained by the heaters HA and HB. Therefore, the energization control for the heater HC is stopped. Meanwhile, the energization control for the heater HD is performed in order to increase an amount of heat supplied to the pressure roller T3 in which the temperature sometimes drops owing to a shortage of the amount of heat supplied thereto immediately after the start of the paper feeding.

It is satisfactory if switching from the state immediately after the start of the paper feeding to the state under paper feeding makes it possible to maintain the temperature of the fixing belt T5 without the heat supply by the heater HC. This may be achieved in such a manner that the image forming apparatus is actually operated, and for example, an elapsed time after the start of the paper feeding, after which the heat supply by the heater HC becomes unnecessary, is measured, and then the switching is performed based on the elapsed time after the start of the paper feeding. Similar measurement and setting may be performed by means of the number of fixed sheets after the start of the paper feeding instead of the elapsed time after the start of the paper feeding. Moreover, the similar measurement and setting may be performed by means of temperature transition of the sensor S1.

During the standby, it is only necessary to maintain the temperatures of the respective members of the fixation device, and accordingly, large power is not required. The power consumptions of the heaters HA and HB are large, and in each of the heaters HA and HB, a temporal drop of a power supply voltage, which is called a flicker, occurs at the time of starting the energization owing to a rush current intrinsic to the halogen lamp. The flicker causes a malfunction such as flickering of lighting of a room which shares the power supply with the image forming apparatus. In order to prevent this, it is desirable to maintain the temperatures of the heat roller and the belt by using the heater HC without using the heaters HA and HB during the standby.

Hence, unlike the other operation states, in the standby state considering power saving, the energization of the heaters HA and HB producing large power consumptions is stopped, and as the heaters (◎) to which the first priorities are given, there are set the auxiliary heater HC of the heat roller T1, the heater HD of the pressure roller T3, and the heater HE of the external heat roller T4.

Specifically, during the standby, the heater HD of the pressure roller T3 and the heater HE of the external heat roller T4 are energized, and as described above, the temperature drop of the pressure roller T3 difficult to be heated radically is thus prevented. In addition, the heat roller T1 energizes the auxiliary heater HC, thus preventing the temperature drop thereof.

As a matter of course, when the image information is inputted to the image forming apparatus during the standby state, the operation state is switched to the priority in the state immediately after the start of the paper feeding, and the energization control is performed.

Next, the energization control in the case of FIG. 2C will be described.

In the energization control in the case where the fixation of the unfixed toner image to the thick paper is regarded as important (the case is also referred to as the case of regarding the thick paper as important), in the case of using, for example, coated paper (for example, with basis weight of $200\times10^{-3}$ kg/m$^2$ or more) as the thick paper, the coated paper takes off a larger amount of heat from the fixing belt T5 since the coated paper has a large heat capacity. As a result, there occurs a larger temperature difference between the heat roller T1 and the surface of the fixing belt T5. Therefore, the temperature drop immediately after the start of the paper feeding becomes larger. On the other hand, since the paper is thick, the influence on the fixation property, which is given by the heat supply from the pressure roller T3, is smaller than in the thin paper, and in the coated paper, the occurrence of curl is minor. Accordingly, the malfunction occurs less even if the temperature of the pressure roller T3 drops to some extent.

Moreover, since the temperature of the fixing belt T5 can be maintained high, the amount of heat which the pressure roller T3 receives from the fixing belt T5 is increased by, for example, bringing the fixing belt T5 and the pressure roller T3 into contact with each other between the fed transfer sheet and the fed transfer sheet. Accordingly, the temperature drop of the pressure roller T3, which is caused because the heat is not supplied thereto from the heater HD incorporated therein, can be absorbed.

Moreover, it is suitable to distribute the power more to the control of the temperature drop of the fixing belt T5. In the construction regarding the thick paper as important, a setting is made to establish a relationship of HC≈HD+HE so that the power for the heater HE incorporated in the external heat roller T4 can be added to the power supplied to the heat roller T1 immediately after the start of the paper feeding.

Specifically, the setting is made so as to substantially equalize the power consumption of the heaters, in which the priorities are changed, between the heater (○) to which the second priority is given and the heaters (Δ) to which the third priorities are given. Accordingly, even if the way of giving the priorities to the heaters to which the second and third priorities are given is changed, the consumption powers can be easily controlled within predetermined ranges.

Moreover, in the state of the warming up (WU), the heaters HD and HE are set as the heaters (○) to which the second priorities are given, and the heater HC is set as the heater (Δ) to which the third priority is given. Furthermore, in the state immediately after the start of the paper feeding, the heater HC is set as the heater (○) to which the second priority is given, and the heaters HD and HE are set as the heaters (Δ) to which the third priorities are given.

Moreover, in the state under paper feeding, a setting is made so that the same priorities as those in the state of the warming up (WU) can be given to the heaters. In the standby state, the energization control for the heaters HA and HB is stopped.

The description has been made above of the fixation device which performs the energization control in the case of regarding the plain paper as important, and of the fixation device which performs the energization control in the case of regarding the thick paper as important. Next, a description will be made of a fixation device, in which two auxiliary heaters HC are provided in the heat roller T1, and the two heaters are used in a switching manner, thus making it possible to perform the energization control in the case of regarding the plain paper as important and the case of regarding the thick paper as important.

A fixation device shown in FIG. 3 has basically the same construction as the fixation device shown in FIG. 2A. However, in the heat roller T1, a heater HC1 for use in the case of regarding the plain paper as important and a heater HC2 for use in the case of regarding the thick paper as important are provided as the auxiliary heaters. Note that objects denoted by the same reference numerals and symbols as in FIG. 2A represent the same as in FIG. 2A.

Moreover, with regard to power consumptions of the heaters of the fixation device in this embodiment, as shown in the table of the case of regarding the plain paper as important in FIG. 2B and in the table of the case of regarding the thick paper as important in FIG. 2C, distributions of the power consumption are made to differ depending on whether the transfer sheet P is the plain paper or the thick paper.

Although details will be described later, the heaters HC1 and HC2 are used in the switching manner depending on whether the transfer sheet P is the plain paper or the thick paper, and a cordingly, are not energized simultaneously. For example, in the case of using the plain paper as the transfer sheet, the heater HC1 is used, and the priority given to the heater HC in FIG. 2B is given thereto, and the energization control is performed therefor. Moreover, in the case of using the thick paper as the transfer sheet, the heater HC2 is used, and the priority given to the heater HC in FIG. 2C is given thereto, and the energization control is performed therefor.

Hence, the fixation device in this embodiment uses the heaters HC1 and HC2 in the switching manner depending on whether the plain paper or the thick paper is used as the transfer sheet, thus making it possible to easily perform individually the energization control of the case of regarding the plain paper as important and the energization control of the case of regarding the thick paper as important.

Specifically, when the transfer sheet P is the thick paper, the thickness thereof is thicker than when the transfer sheet P is the plain paper, and the thermal conductivity thereof is not as good. Accordingly, for the purpose of facilitating the fixation of the toner image, when it is assumed that the transfer sheet is inserted in the direction of the arrow X, for example, the power consumption of the heater HC1 is made larger than the power consumption of the heater HC2 of the case of regarding the plain paper as important in order to increase the heat capacity of the heat roller T1 located on the toner image side on the transfer sheet.

In this embodiment, for example, if the energization control in the case of regarding the plain paper as important is called a plain paper mode, and the energization control in the case of regarding the thick paper as important is called a thick paper mode, then, as shown in the specification table of FIG. 2B, the power consumptions of the respective heaters are set as follows in the case of the plain paper mode in which the plain paper is used as the transfer paper P: the power consumptions of the main heaters HA and HB incorporated in the heat roller T1 are set at 810 W and 640 W, respectively; the power consumption of the auxiliary heater HC1 incorporated in the heat roller T1 is set at 300 W; the power consumption of the heater HD incorporated in the pressure roller T3 is set at 300 W; and the power consumption of the heater HE incorporated in the external heat roller T4 is set at 250 W.

Moreover, in the case of the thick paper mode in which the thick paper is used as the transfer sheet P, as shown in the specification table of FIG. 2C, the power consumptions of the respective heaters are set as follows: the power consumptions of the main heaters HA and HB incorporated in the heat roller T1 are set at 810 W and 640 W, respectively; the power consumption of the heater HD incorporated in the heat roller T3 is set at 300 W; the consumption power of the heater HE incorporated in the external heat roller T4 is set at 250 W; the consumption power of the auxiliary heater HC2 is set at 550 W which is larger than in the plain paper mode by 250 W.

The total power consumption in the case of the plain paper mode becomes 2300 W, and the total power consumption in the case of the thick paper mode becomes 2550 W. If it is assumed that the allowable power consumption allocated as the power consumptions of the heaters of the fixation device is 2 kW as described above, then the total power consumption in the plain paper mode exceeds the allowable power consumption by 300 W, and the total power consumption in the thick paper mode exceeds the allowable power consumption by 550 W. However, the heaters HC1 and HC2 are used in the switching manner depending on whether the transfer sheet P is the plain paper or the thick paper, and the priorities are given to the respective heaters in response to the operation states. Accordingly, all the heaters are not energized or turned on simultaneously. Therefore, no problem occurs even if the power consumptions are distributed to the heaters in the above-described manner.

Note that the priorities set for the respective heaters in this embodiment may be set arbitrarily as long as the respective heaters are energized efficiently to perform the heating operations in accordance with the thickness of the transfer material and the operation state of the image forming apparatus within the preset range of the power consumptions, and the fixing temperatures suitable for the respective operation states are obtained. The priorities for the heaters are not limited to the above-described ones.

The circuit configuration of the image forming apparatus according to the present invention will be briefly described with reference to FIG. 4. Note that a description will be made of the case where the image forming apparatus is a copier in this embodiment.

Reference numeral 100 denotes a configuration of various members and circuits of the entire image forming apparatus 20. Reference numeral 110 denotes a CPU which controls the entire image forming apparatus, in which programs of various modes for controlling the image forming apparatus 20, data necessary for executing the programs, and the like are prestored.

To the CPU 110, there are connected an information control circuit 120, an image processing circuit 140, a drive control circuit 150, a power supply circuit 400, and the like. The control unit EC shown in FIG. 1 comprises these circuits, thus making it possible to control the entire image forming apparatus 20.

The information control circuit 120 connects to an external information instrument 500 through an interface (I/F) 130 according to an instruction of the CPU 110, receives the image information on the characters, the images, and the like, and setting information on a density, a magnification, and the like necessary for the image formation and the like, and stores these kinds of information in a storage unit 160.

The information control circuit 120 is adapted to output the setting information and the like stored in the storage unit 160 to the image processing circuit 140, the drive control circuit 150, a display device 300, or the like.

Moreover, the information control circuit 120 has a function to determine information to be described below, and to transmit the information to the respective circuits and various members of the image forming apparatus smoothly as appropriate so that troubles cannot occur in the operation of the image forming apparatus. For example, the information includes a variety of information inputted to an operation input unit 200, information indicating operation states outputted by the various members under operation, and the like, which are related to instruction information necessary for the operations of the circuits including the image processing circuit 140, the drive control circuit 150, and the like, as well as JOB information formed of the image information inputted from the external information instrument 500, the setting information, and the like.

Note that, though the external information instrument 500 is mainly a computer or an Internet server, such an information instrument as another image forming apparatus on a local area network (LAN), a digital camera, and a measurement apparatus capable of outputting information measured thereby is assumed depending on the case.

Moreover, in this embodiment, according to the instruction of the CPU 110, the information control circuit 120 classifies the operation state of the image forming apparatus into a plurality of operation states, and for each of the classified operation states, performs the energization control for the individual heaters (heaters HA to HE) of the fixation device 10 through the drive control circuit 150 based on the priorities preset for the heaters of the fixation device.

The interface (I/F) 130 is an information delivery unit, and is composed to be connectable through various networks to the external information instrument 500 such as the above-described computer, another image forming apparatus, and an Internet server.

The operation input unit 200 is an input device provided on the control panel CP of the image forming apparatus 20. There are assumed the liquid crystal display device DP as the display device of the touch-panel system, the keyboard KB, the start button SK, which are described above, and the like.

For example, by operating the keyboard KB, it is made possible to input the setting information on the output number of transfer materials, a type of the transfer material, which includes index paper, thick paper, plain paper, thin paper, recycled paper, OHP sheets, and the like, or the magnification including enlargement and contraction, the density of the outputted image, and the like.

Moreover, depending on the case, the operation input unit 200 also becomes an input unit for setting various operation modes of the image forming apparatus 20, for example, color and monochrome modes, simplex and duplex modes, and the like, which are selected and set in the case of performing the image formation.

It is supposed that the energization control in the case of regarding the plain paper as important is referred to as the plain paper mode, and that the energization control in the case of regarding the thick paper as important is referred to as the thick paper mode. Then, in particular, in this embodiment, depending on whether the transfer sheet is the plain paper or the thick paper, the heaters HC1 and HC2 of the fixation device are switched, and the setting for the priorities and the like for the heaters is switched. In such a way, the energization control in the plain paper mode or the thick paper mode can be performed.

The display device 300 comprises the above-described liquid crystal display device, the display device DP in which the touch panel and the like are incorporated in the liquid crystal display unit, or the like.

On the display device 300, there are displayed a list of an operation procedure and a variety of information in the case of inputting the information by the operation input unit 200, the information stored in the storage unit 160, an operation status of the image forming apparatus 20, an alert, or the like.

The image processing circuit 140 is a circuit which stores the image information of the original read by the image reading device 13 as the image data in the storage unit 160, and converts the image data into data, a signal, and the like suitable for the image forming system of the image forming unit 11 in the case of forming the image in the image forming unit 11 based on the image data stored in the storage unit 160.

The drive control circuit 150 is a circuit for, according to the instruction of the CPU 110, operating the following respective devices, members, and the like at appropriate timing based on the preset operation modes in cooperation with the image processing circuit 140. The respective devices, members, and the like are the transfer members 8, the fixation device 10, the image forming unit 11, the image reading device 13, the paper feed device 14, the auto document feeder 30, and the like.

The storage unit 160 stores the JOB information formed of the image data necessary for forming the image, the setting conditions for controlling the image forming apparatus 20, and the like, JOB data related to the JOB information, and the information on the programs and the like for the various setting modes.

In this embodiment, in particular, the priorities, which are preset for the individual heaters (heaters HA to HE) of the fixation device so as to correspond to the energization control modes including the plain paper mode and the thick paper mode for each of the plurality of classified operation states obtained by classifying the operation state of the image forming apparatus, are stored, for example, as a matrix.

Hence, in the case of controlling the fixing temperature, according to the instruction of the CPU 110, the information control circuit 120 determines the operation state of the image forming apparatus, and reads out the priorities for the individual heaters, which are stored for each of the classified operation states. Then, the energization control for the heaters of the fixation device 10 is performed through the drive control circuit 150 based on the read-out priorities for the heaters.

Note that, with regard to the transfer members 8, the fixation device 10, the image forming unit 11, the image reading device 13, the paper feed device 14, and the auto document feeder 30, details thereof are omitted, and items thereof relating to the circuit are briefly described here.

The image reading device 13 is operated by the drive control circuit 150. The image reading device 13 reads, by the reading device ES, the image information of the original fed to the reading position. For example, the image information thus read is converted into the image data by the image processing circuit 140, and is stored in the storage unit 160.

The image forming unit 11 is operated by the drive control circuit 150 according to the instruction of the CPU 110. The image processing circuit 140 forms the toner images of yellow, magenta, cyan, and black on image bearing members (photosensitive drums 5) by the respective image forming units 11Y, 11M, 11C and 11K based on the image data stored in the storage unit 160. Then, the image forming unit 11 transfers the formed toner images to the intermediate transfer body 16.

The transfer rollers 8 as the transfer members are operated by the drive control circuit 150. The charges reverse in polarity to the toner images superposed on the intermediate transfer body 16 are imparted to the transfer rollers 8. In such a way, the transfer rollers 8 operate to transfer the toner images to the transfer sheet P. Note that the transfer rollers 8Y, 8M, 8C and 8K operate to transfer, to the intermediate body member 16, the toner images formed on the photosensitive drums 5 by the image forming units 11Y, 11M, 11C and 11K.

As described above, the toner images are transferred to the transfer sheet P by performing the energization control for the individual heaters (heaters HA to HE) of the fixation device 10 based on the priorities preset for the individual heaters for each of the operation states classified so as to correspond to the energization control mode such as the plain paper mode and the thick paper mode. In this embodiment, the fixation device 10 fuses and adheres the toner images described above by the heat, pressure, and the like of the pressure contact portion of the fixation device according to the instruction of the drive control circuit 150, thereby fixing the toner images.

The paper feed device 14 is operated by the drive control circuit 150 based on the program preset in the CPU 110 in cooperation with the transfer members 8, the fixation device 10, the image forming unit 11, and the like. The paper feed device 14 operates to feed the transfer sheet P smoothly at good timing.

As shown in FIG. 1, the auto document feeder 30 is a device which automatically feeds, by means of the original feed device, the originals mounted on the original mount stage 32 one by one to the reading position. The auto document feeder 30 operates in conjunction with the drive control circuit 150 according to the instruction of the CPU 110 of the image forming apparatus 20.

For the sensors S, non-contact temperature sensors are used in this embodiment. For example, the temperature sensor S1 for the heat roller, the temperature sensor S3 for the pressure roller, and the temperature sensor S4 for the external heat roller are provided.

Note that, though the temperature sensors S may be those commercially available, and may also be contact temperature sensors, the non-contact temperature sensors which are less vulnerable to damages on the rollers and the like are preferable. It is desirable that the sensors can store currents and voltages, which are outputted thereby so as to correspond to the detected surface temperatures, as output values (temperature information) in the storage unit 160.

When a power supply switch (not shown) is turned on by an operation of the user, the power supply circuit 400 makes appropriate energization from the power supply to the entire image forming apparatus. When the power supply switch is shut off, the power supply circuit 400 shuts the energization.

Note that, even if the power supply switch is turned on, for example, in the case of the power saving mode of making the image forming apparatus on standby, and the like, the power supply circuit 400 can continue only energization necessary for storing temporal storage contents and the like of a memory and shut another energization for the heaters of the fixation device, and the like according to the instruction of the CPU 110.

Moreover, even if the power supply is shut (OFF) by the power supply switch, not all the power supply is shut as in the above-described case of the power saving mode of making the image forming apparatus on standby, and the like, the energization necessary for operating the CPU 110 and the like may be performed, thus making it possible to start the image formation rapidly so as to correspond to the case where the power supply switch is turned on, the case where the image information is inputted thereto, and the like.

Next, a description will be made of a procedure of the energization control for each of the heaters of the fixation device with reference to FIG. 5.

As a premise, as described above, the energization control in the case of regarding the plain paper as important is referred to as the plain paper mode, the energization control in the case of regarding the thick paper as important is referred to as the thick paper mode, and the image forming apparatus is the copier. Moreover, it is premised that the construction of the fixation device is one as shown in FIG. 3.

Hence, a description will be made here of the fixation device which can switch the plain paper mode and the thick paper mode. However, the same procedure is basically performed also in the case of controlling the plain paper mode and the thick paper mode separately from each other except a portion executed based on a determination as to whether the transfer sheet is the plain paper or the thick paper. Note that, with regard to the procedure in the case of the thick paper mode, only a portion thereof different from the case of the plain paper mode will be described.

The specifications of the priorities and the like of the heaters in the case of the plain paper mode, which are set in response to the respective operation states of the image forming apparatus, are in accordance with those of FIG. 2B, and the specifications of the priorities and the like of the heaters in the case of the thick paper mode, which are set as described above, are in accordance with those of FIG. 2C.

Note that, for the purpose of simplifying the explanation, descriptions of the energization controls for the heaters (¤) to which the first priorities are given are omitted. A specific description will be made below by referring to FIG. 1 to FIG. 4 as appropriate.

(ST1)

This is a step of determining whether or not the mode is the plain paper mode. In this embodiment, the energization control mode is switched to the plain paper mode or the thick paper mode depending on whether the transfer sheet for use is the plain paper or the thick paper. Moreover, the priorities set for the respective heaters for each of the operation states of the image forming apparatus also differ depending on whether the energization control mode is the plain paper mode or the thick paper mode.

Hence, this step is a step executed first, for example, immediately after the power supply is turned on or every time when one JOB is executed in order to confirm whether the transfer sheet for use is the plain paper or the thick paper.

The information control circuit 120 confirms whether the set transfer sheet is the plain paper or the thick paper. In the case of the plain paper, the procedure proceeds to ST2 in order to set the plain paper mode, and in the case of not being the plain paper mode, that is, in the case of the thick paper, the procedure proceeds to ST3.

Note that, with regard to the information as to whether the transfer sheet is the plain paper or the thick paper, the information on the transfer sheet may be automatically obtained from the paper feed cassette, or the information concerned may be set by the operation input unit.

(ST2)

This is a step of making a setting of the heaters for the plain paper, that is, of setting the priorities for the plain paper mode to the respective heaters for each of the operation states. For example, the information control circuit 120 reads out the data regarding the priorities in the plain paper mode, which correspond to FIG. 2B, from the storage unit 160 of the control circuit, makes a setting through the drive control circuit 150 so as to make it possible to energize the auxiliary heater HC1 of the fixation device of FIG. 3, and makes a setting therethrough so as to make it possible to start the energization control for the respective heaters in response to the read-out priorities. Then, the procedure proceeds to ST4.

(ST3)

This is a step of making a setting of the heaters for the thick paper, that is, of setting the priorities for the thick paper mode to the respective heaters for each of the operation states. In a similar way to ST2, the information control circuit 120 reads out data regarding the priorities in the thick paper mode, which correspond to FIG. 2C, from the storage unit 160. In the case where a setting is made so as to make it possible to energize the auxiliary heater HC1 of the fixation device of FIG. 3, a switching is made through the drive control circuit 150 so as to make it possible to energize the auxiliary heater HC2. In such a way, a setting is made so as to make it possible to start the energization control for the respective heaters. Then, the procedure proceeds to ST4.

(ST4)

This is a step of determining whether or not a current state is the state of the warming up (WU). The information control circuit 120 detects the operation state of the image forming apparatus. When it has been detected that the image forming apparatus is under warming up (WU), the procedure proceeds to ST5. When it has been detected that the image forming apparatus is not under warming up (WU), the procedure proceeds to ST6.

(ST5)

This is a step of making a control to stop the energization of the auxiliary heater HC of the heat roller T1 while the heater (○) to which the second priority is given is being energized because the auxiliary heater HC is set as the heater (Δ) to which the third priority is given while the energization of the heater HC is being stopped, that is, in the state of the warming up (WU).

Note that, when the auxiliary heater HC is mentioned below, the auxiliary heater HC is the auxiliary heater HC1 (300 W) in the case of the plain paper mode, and is the auxiliary heater HC2 (550 W) in the case of the thick paper mode.

The information control circuit 120 reads out the priorities corresponding to the state of the warming up (WU) from the storage unit 160, sets the priorities for the respective heaters, and starts the energization control corresponding to the priorities for the respective heaters of the fixation device through the drive control circuit 150. Then, the procedure proceeds to ST6.

(ST6)

This is a step of determining whether the current state is the state immediately after the start of the paper feeding. The information control circuit 120 detects the operation state of the image forming apparatus. When it has been detected that the operation state is the state immediately after the start of the paper feeding, the procedure proceeds to ST7. When it has been detected that the operation state is not the state immediately after the start of the paper feeding, the procedure proceeds to ST10.

(ST7)

This is a step of determining whether or not the mode is the plain paper mode. Specifically, in the state immediately after the start of the paper feeding, the distributions of the power consumptions of the heaters differ as described above between the plain paper mode and the thick paper mode, and the settings of the priorities also differ therebetween. Accordingly, this is a step of confirming the energization control mode in order to set appropriate priorities for the respective heaters.

The information control circuit 120 confirms the energization control mode which is being set. In the case of the plain paper mode, the procedure proceeds to ST8. In the case of not being the plain paper mode, that is, in the case of the thick paper mode, the procedure proceeds to ST9.

(ST8)

This is a step of making a control to stop the energization of the auxiliary heater HD of the pressure roller T3 while the heater (○) to which the second priority is given is being energized because the heater HD is set as the heater (Δ) to which the third priority is given while the energization of the heater HD is being stopped, that is, in the state immediately after the start of the paper feeding in the plain paper mode.

The information control circuit 120 reads out the priorities corresponding to the state immediately after the start of the paper feeding in the plain paper mode from the storage unit 160, sets the priorities for the respective heaters, and starts the energization control corresponding to the priorities for the respective heaters of the fixation device through the drive control circuit 150. Then, the procedure proceeds to ST10.

(ST9)

This is a step of making a control to stop the energization of the auxiliary heater HD of the pressure roller T3 and the heater HE of the external heat roller T4 while the heater (○) to which the second priority is given is being energized because the auxiliary heater HD and the heater HE are set as the heaters (Δ) to which the third priorities are given while the energization of the heaters HD and HE is being stopped, that is, in the state immediately after the start of the paper feeding in the thick paper mode.

The information control circuit 120 reads out the priorities corresponding to the state immediately after the start of the paper feeding in the thick paper mode from the storage unit 160, sets the priorities for the respective heaters, and starts the energization control corresponding to the priorities for the respective heaters of the fixation device through the drive control circuit 150. Then, the procedure proceeds to ST10.

(ST10)

This is a step of determining whether or not the state is the state under paper feeding. The information control circuit 120 detects the operation state of the image forming apparatus. When it has been detected that the state is the state under paper feeding, the procedure proceeds to ST11. When it has been detected that the state is not the state under paper feeding, the procedure proceeds to ST 12.

(ST11)

This is a step of making a control to stop the energization of the auxiliary heater HC of the heat roller T1 while the heater (○) to which the second priority is given is being energized because the auxiliary heater HC is set as the heater (Δ) to which the third priority is given in a similar way to the state of the warming up (WU) in ST5 while the energization of the auxiliary heater HC is being stopped, that is, in the state under paper feeding.

The information control circuit 120 reads out the priorities corresponding to the state under paper feeding from the storage unit 160, sets the priorities for the respective heaters, and starts the energization control corresponding to the priorities for the respective heaters of the fixation device through the drive control circuit 150. Then, the procedure proceeds to ST12.

(ST12)

This is a step of determining whether or not the state is the standby state. The information control circuit 120 detects the operation state of the image forming apparatus. When it has been detected that the state is the standby state, the procedure proceeds to ST13. When it has been detected that the state is not the standby state, the procedure proceeds to ST14.

(ST13)

Unlike other operation states, in the standby state, that is, while the energization of the heaters HA and HB is being stopped, the energization of the heaters HA and HB of which power consumptions are large is stopped and the minimum necessary energization is performed so that the fixing temperature cannot drop and in consideration of the power saving.

Accordingly, as the heaters (◎) to which the first priorities are given, there are set the auxiliary heater HC of the heat roller T1, the heater HD of the pressure roller T3, and the heater HE of the external heat roller T4; however, the heater (○) to which the second priority is given, and the heater (Δ) to which the third priority is given, are not set.

The information control circuit 120 reads out the priorities corresponding to the standby state from the storage unit 160, sets the priorities for the respective heaters, and starts the energization control corresponding to the priorities for the respective heaters of the fixation device through the drive control circuit 150. Then, the procedure proceeds to ST14.

(ST14)

This is a step of determining whether or not the operation is to be ended. The information control circuit 120 detects whether or not the end of the operation of the image forming apparatus is set, for example, by the operation input unit 200 and the like. When the end of the operation is set, the procedure proceeds to ST15. When the end of the operation is not set, the information control circuit 120 determines that the operation is to be continued, and the procedure returns to ST1.

(ST15)

The entire energization is shut. Specifically, the CPU 110 of the control circuit operates the power supply circuit 400, shuts the energization of all the devices including the heaters of the fixation device, and the like, and ends the operation of the image forming apparatus.

Note that the procedure of the energization control for the heaters of the fixation device, which is described above, is a mere example. The energization control just needs to be performed based on the priorities set in response to the operation mode and the operation state, and the procedure is not limited to the above.

As above, the description has been made of the case of performing the energization control while switching the plain paper mode and the thick paper mode depending on whether the transfer sheet is the plain paper and the thick paper. In the case of singly performing each of the plain paper mode and the thick paper mode, the energization control in each thereof can be performed in the basically same procedure, for example, except the step of determining whether the mode is the plain paper mode or the thick paper mode, and the like.

Moreover, the priorities for the heaters are changed and set so as to make it possible to perform the energization control in response to the energization control mode such as the plain paper mode and the thick paper mode and so as to make it possible to perform the energization control in response to the operation state. In such a way, an image forming apparatus further capable of preventing an occurrence of a fixation defect and the like, and of forming high-quality images can be provided.

A description will be briefly made of a flow of the operation state of the image forming apparatus with reference to FIG. 6.

The state of the warming up (WU), the state immediately after the start of the paper feeding, the state under paper feeding, and the standby state, which are classified from the operation state of the image forming apparatus, have been individually described. The operation state of the image forming apparatus assumed to the copier covers a period from the turning on of the power supply thereof through the image formation to the shutting of the power supply. Here, a description will be made of relations in a series of the operation states in accordance with the flowchart.

(ST101)

This is a step of turning on the power supply. When the power supply of the image forming apparatus is turned on, the CPU 110 of the control circuit EC is activated, and the control is started for the respective members of the image forming apparatus by the preset operation program so that the members concerned can perform the image formation. Then, the flow proceeds to ST102.

(ST102)

This is the state of the warming up (WU). In the fixation device, the respective heaters are energized at the priorities preset in response to the operation state so as to reach the predetermined fixing temperature within a shortest possible period. Then, the flow proceeds to ST103.

(ST103)

This is a step of determining whether or not the fixation device has reached the predetermined fixing temperature. For example, the temperature of the fixation device is detected by the temperature sensors S. When it has been determined that the fixation device has reached the predetermined fixing temperature, it is determined that the state of the warming up (WU) is completed, and the flow proceeds to ST104. When it has been determined that the fixation device has not reached the predetermined fixed temperature, the flow returns to ST102 in order to continue the state of the warming up (WU).

(ST104)

This is the standby state. This is a state after the state of the warming up (WU) is completed or a state of waiting for an input of image information as the next JOB after the image formation as one JOB is completed. The fixation device energizes the respective heaters at the priorities preset in response to the operation state so as to maintain the predetermined fixing temperature. Then, the flow proceeds to ST105.

(ST105)

This is a step of determining whether or not the image formation is to be started. For example, when it has been detected that the image information as the JOB is inputted, the CPU 110 instructs, for example, the drive control circuit 150 and the like to start a series of the image formation, in which the electrostatic latent images are formed on the photosensitive drums based on the inputted image information, and the toner images which are developed by the toner and transferred to the transfer sheet are fixed by the fixation device, followed by discharging. Then, the flow proceeds to ST106. When the image information is not inputted, the flow returns to ST104 in order to continue the standby state.

(ST106)

This is the state immediately after the start of the paper feeding. This is such a state where the image formation is started and the fixing temperature of the pressure contact portion radically drops owing to the heat absorption by the transfer sheet. In order to recover the dropped fixing temperature, the respective heaters are energized at the priorities preset in response to the operation state. Then, the flow proceeds to ST107.

(ST107)

This is a step of determining whether or not paper feeding conditions are satisfied. Specifically, this is a step of determining whether or not the state is to be shifted from the state immediately after the start of the paper feeding to the state under paper feeding by determining whether or not the paper feeding conditions are satisfied.

Conditions for shifting the state to the state under paper feeding are referred to as the paper feeding conditions. The paper feeding conditions which define either of the following states as the state immediately after the start of the paper feeding are set. One of the states is a state from the time when the transfer sheet on which the image is formed is first fed to the fixation device until the elapse of the predetermined time or until the feeding of the predetermined number of sheets is completed. The other state is a state from the time when the feeding of the transfer sheet is started until the temperature of the fixation device, which has dropped owing to the heat absorption by the fed transfer sheet, is recovered to the predetermined temperature. When current conditions exceed the above-defined conditions, it is determined that the paper feeding conditions are satisfied, and the flow proceeds to ST108. When the paper feeding conditions are not satisfied, the respective heaters are energized at the priorities preset in response to the operation state in order to continue the state immediately after the start of the paper feeding. Then, the flow returns to ST106.

Note that, in the case of determining whether or not the paper feeding conditions are satisfied, for example, it is preferable to provide a timer which counts the time, a counter which counts the number of image-formed sheets, a circuit which determines the transition of the temperature detected by the temperature sensor, or the like, thereby determining whether or not the above-described paper feeding conditions have been satisfied.

(ST108)

This is the state under paper feeding. The image formation is continuously performed after the state immediately after the start of the paper feeding. The respective heaters are energized at the priorities preset in response to the operation state in order to maintain the fixation device at the predetermined fixing temperature, and not to cause the fixation defect and the like. Then, the flow proceeds to ST109.

(ST109)

This is a step of determining whether the image formation is to be ended. For example, when the image formation based on the image information inputted as one JOB is ended, the flow proceeds to ST110. When the image formation is being continued, the respective heaters are energized at the priorities preset in response to the operation state in order to continue the state under paper feeding. Then, the flow returns to ST108.

(ST110)

This is a step of determining whether or not the operation is to be ended. When the operation of the image forming apparatus is to be ended, the flow proceeds to ST111. When the operation of the image forming apparatus is to be continued, the flow returns to ST104 in order to continue the state under operation.

(ST111)

This is a step of shutting the power supply and ending the operation of the image forming apparatus. When the power supply is shut, the entire operation of the image forming apparatus is ended.

In this embodiment, the operation state of a series of the image formation from the time when the power supply is turned on to the image forming apparatus to the time when the power supply is shut is determined in the above-described manner. Then, the operation state is classified into the four operation states, which are: the state of the warming up (WU); the state immediately after the start of the paper feeding; the state under paper feeding; and the standby state. Moreover, the respective heaters of the fixation device are controlled to be energized at the priorities preset in response to the classified operation states.

With regard to the energization control for the heaters of the fixation device in the image forming apparatus in this embodiment described above, a description will be made of experiment results of Example and Comparative example, in both of which experiments are performed under the following conditions, with reference to FIG. 1 to FIG. 7 as appropriate.

EXAMPLE

(A) Example

Fixation Device of This Embodiment (1) Conditions

Structure of fixation device . . . refer to FIG. 2A

Specifications of heaters of fixation device . . . refer to FIG. 2B

Priorities of heaters of fixation device: to be changed for each operation state . . . refer to FIG. 2B Transfer sheet: plain paper ($128\times10^{-3}$ kg/m$^2$)

Priorities

(B) Comparative Example

Conventional Fixation Device (1) Conditions

Structure of fixation device . . . refer to FIG. 2A

Specifications of heaters of fixation device . . . refer to FIG. 2D

Priorities of heaters of fixation device: to be fixed . . . refer to FIG. 2D Transfer sheet: plain paper ($128\times10^{-3}$ kg/m$^2$)

FIG. 7A and FIG. 7B are graphs in each of which an axis of ordinates represents a temperature (° C.) and an axis of abscissas represents a time (s: second). The graphs show the surface temperatures (Aa, Ba) of the fixing belt and the surface temperatures (Ab, Bb) of the pressure roller when the state immediately after the warming up (WU) is ended and the paper feeding is started, that is, the state immediately after the start of the paper feeding is recorded for approximately 100 seconds.

FIG. 7A shows Comparative example, and is a graph by the energization control in the state where the priorities for the heaters in the conventional fixation device are fixed. FIG. 7B shows Example, and is a graph by the energization control in the state where the priorities for the heaters in the fixation device in this embodiment are changed for each of the operation states.

The experiments are performed under the above-described conditions. The configuration of the power (consumption power) of the heaters of Comparative example (conventional fixation device) is the same as that of Example (fixation device of this embodiment).

As shown in FIG. 2D, the priorities for the heaters of Comparative example are always fixed, and are not changed according to the operation state in the case of displaying the priorities for each of the operation states in a similar way to this embodiment.

Specifically, in Comparative example, the priority for the heater HD of the pressure roller T3 is always set higher than that for the auxiliary heater HC of the pressure roller T1 from the state of the warming up (WU) to the state under paper feeding except the standby state considering the power saving. When the priorities of Comparative example are written in the same way as in the case of this embodiment on purpose, the heater HD of the pressure roller T3 is always set as the heater to which the second priority is given, and the auxiliary heater HC is always set as the heater to which the third priority is given.

Hence, though the fixing temperature immediately after the completion of the warming up (WU) operation reaches the predetermined temperature particularly immediately after the start of the paper feeding as described above, the state in Comparative example is such a state where the fixing temperature of the pressure contact portion radically drops owing to the temperature difference between the heat roller T1 and the fixing belt T5. Accordingly, in order to restrict the temperature drop as described above, a large amount of heat is required on the heat roller side.

However, in Comparative example, the auxiliary heater HC of the heat roller T1 is set as the heater to which the third priority is given. Accordingly, the auxiliary heater HC is not energized unless the energization of the heater HD of the pressure roller T3, which is set as the heater to which the second priority is given, is stopped.

In this connection, in the heat roller T1, though the main heaters HA and HB are energized, the auxiliary heater HC cannot be energized. Then, as shown in FIG. 7A, the drop of the surface temperature Aa of the fixing belt cannot be controlled, and the surface temperature that is approximately 200° C. at an initial stage drops down to approximately 180° C.

Hence, though the temperature gradually rises with an elapse of the time, a gloss defect, and further, the fixation defect sometimes occur in that state immediately after the start of the paper feeding, which is also an initial state of the start of the paper feeding.

Meanwhile, in Example, in the state immediately after the start of the paper feeding, the auxiliary heater HC of the heat roller T1 is set as the heater to which the second priority is given, and the heater HD of the pressure roller T3 is set as the heater to which the third priority is given. Accordingly, in Example, the auxiliary heater HC of the heat roller T1 is energized at the time of the state immediately after the start of the paper feeding. Therefore, as shown in FIG. 7B, the drop of the surface temperature Ba of the fixing belt can be controlled, and the surface temperature remains at around 200° C.

In Example, the operation state is changed from the state immediately after the start of the paper feeding to the state under paper feeding in 40 seconds after the start of the paper feeding. Moreover, in Example and Comparative example, the basis weight of $135\times10^{-3}$ kg/m$^2$ is set as an upper limit of the plain paper. Accordingly, the data in FIG. 7A and FIG. 7B is of the plain paper mode which represents the energization control of the case of regarding the plain paper as important.

Note that, in Example, the heater HD of the pressure roller T3 is not energized in the state immediately after the start of the paper feeding. However, as described above, the surface of the pressure roller T3 is heated by the heater HE of the external heat roller T4. Moreover, the heat is supplied to the surface of the pressure roller T3 from the fixing belt T5 maintained at the predetermined temperature by, for example, the contact of the fixing belt T5 and the pressure roller T3 between the fed transfer sheet and the fed transfer sheet. Accordingly, as shown in FIG. 7B, the surface temperature (Bb) of the pressure roller T3 does not drop, and is substantially equal to the surface temperature (Ab) of the pressure roller T3 in Comparative example shown in FIG. 7A.

Hence, in Example in which the priorities for the heaters are changed in the state immediately after the start of the paper feeding, the auxiliary heater HC of the heat roller T1 is energized, and the surface temperature of the fixing belt located on the toner image side of the transfer material is stabilized, heating can be performed more efficiently than in Comparative example in which the priorities for the heaters are fixed, and the heating can be realized within the range of the allowable power consumption. Accordingly, in Example, the image forming apparatus which can form the high-quality image without causing the fixation defect can be provided.

As above, the present invention has been described based on this embodiment. In this embodiment, the operation state of the image forming apparatus is classified into the plurality of operation states, and to the plurality of heaters, there are given any of at least three priorities which are the first, second and third priorities for energizing the heaters so that the total power consumption thereof cannot exceed the predetermined value in response to the respective classified operation states of the image forming apparatus. Accordingly, the control unit performs the energization control for the heaters based on these priorities in response to the operation states, thus making it possible to perform the optimum temperature control for the fixation device in the image forming apparatus within the range of the predetermined power consumption in response to the operation state, and to provide the image forming apparatus which can form the high-quality image free from the occurrence of the fixation defect and the like.

Moreover, in the case of using the plain paper or the thick paper as the transfer materials different in thickness, it is preferable to give, to the plurality of heaters, any of at least the three priorities which are the first, second and third priorities for energizing the heaters so that the total power consumption thereof can not exceed the predetermined value in response to the thickness of the transfer material and the operation states. In such a way, an image forming apparatus which can obtain the stable fixing temperature irrespective of the thickness of the transfer material and can form the high-quality image free from the fixation defect and the like can be provided.

Furthermore, it is preferable to set the power consumptions of the heater to which the second priority is given and the heater to which the third priority is given so as to be substantially equal to each other. In such a way, even if the priorities for the heater to which the second priority is given and the heater to which the third priority is given are changed for each of the operation states, the efficient energization control can be performed within the range of the predetermined power consumption.

Furthermore, it is preferable to classify a series of the operation states of the image forming apparatus from the turning on of the power supply of the image formation apparatus through the end of the image formation to the shutting of the power supply of the same, for example, into the state of the warming up, the state immediately after the start of the paper feeding, the state under paper feeding, and the standby state according to the conditions individually preset therefor. In such a way, the optimum priorities can be set for the heaters in response to the operation states, and the control unit can perform the efficient energization control within the range of the predetermined power consumptions in response to the operation states.

Furthermore, it is preferable to provide the heaters in the heat roller, pressure roller, and external heat roller of the fixation device including the heat roller, the fixing belt, the fixing roller, the pressure roller, the external heat roller, and the like, and to provide three or more heaters in the heat roller. In such a way, also for the cases of using the plain paper and the thick paper as the transfer materials different in thickness, appropriate energization control can be performed individually therefor. Moreover, the radical drop of the fixing temperature immediately after the start of the paper feeding can be controlled, and the toner image on the transfer material can be fixed appropriately. Accordingly, the image forming apparatus which can form the high-quality image free from the fixation defect and the like can be provided.

Note that the construction of the fixation device, the number and power consumptions of the heaters provided in the fixing members, the classification of the four operation states, and the like are not limited to this embodiment. The priorities given and set for the respective heaters in response to the operation states are not limited to the three priorities, either.

Moreover, the transfer materials different in thickness are not limited to the plain paper or the thick paper. The energization control mode is not limited to the plain paper mode or the thick paper mode according to the thickness of the transfer material, either.

Furthermore, with regard to this embodiment, the description has been made of the copier as an example of the image forming apparatus for the purpose of simplifying the explanation. However, it is needless to say that the image forming apparatus is not limited to the copier as long as the image forming apparatus is one including the fixation device having the plurality of heaters, and that the present invention can be applied to an image forming apparatus such as a printer and a facsimile machine, or a compound machine thereof.

The entire disclosure of Japanese Patent Application No. 2005-058629 filed on Mar. 3, 2005, including specifications, claims, drawings and summaries are incorporated herein by reference in their entirety.

What is claimed is:

1. An image forming apparatus, comprising:

an image forming unit for forming a toner image;

a transfer member for transferring the toner image formed in the image forming unit on a transfer sheet;

a fixation device comprising a plurality of heaters for fixating the transfer member in which the toner image is transferred; and a control unit which performs energization control for the plurality of heaters, wherein the plurality of heaters are energized according to any one of at least three priorities, including a first, a second, and a third priority, so that power consumptions of the plurality of heaters do not exceed a predetermined total power consumption given to each of the plurality of heaters in response to an operation state of the image forming apparatus, the priorities of the plurality of heaters being changed to different priorities in response to the operation state, and wherein the control unit performs the energization control for the plurality of heaters by setting the first priority and the second priority when the image forming apparatus is in the operation state, by not energizing the heater to which the third priority is given while the heater to which the second priority is given is energized, and by performing the energization control for the heater to which the third priority is given while the heater to which the second priority is given is not energized.

2. The image forming apparatus of claim 1, wherein the priorities are given to the heaters in response to the operation state of the image forming apparatus and a thickness of a transfer material.

3. The image forming apparatus of claim 1, wherein the power consumption of the heater to which the second priority is given and the power consumption of the heater to which the third priority is given are set to be substantially equal to each other.

4. The image forming apparatus of claim 1, wherein the operation state is a series of operation states starting from turning on a power supply of the image forming apparatus, through image formation based on image formation inputted to the image forming apparatus, and to shutting off of the power supply, wherein the operation state is classified according to individually preset conditions into at least four operation states including a state of warming up, a state immediately after a start of paper feeding, a state during paper feeding, and a standby state, the state of the warming up being one that the power supply is turned on and a predetermined member of the image forming apparatus reaches a predetermined temperature, the state immediately after the start of paper feeding being one from execution of the image formation after the state of warming up and the start of the feeding of the transfer sheet on which the toner image is first formed to an elapse of a predetermined time or to completion of feeding of a predetermined number of sheets, or from the start of the feeding of the transfer sheet to recovery of a temperature of the fixation device, the temperature having dropped during heat absorption of the fed transfer sheet to a predetermined temperature, the state during paper feeding being one that the transfer sheets on which the image is continuously formed after the state immediately after the start of the paper feeding are fed to the fixation device, and the standby state being one of waiting for the input of the image formation after the state of warming up or the state during paper feeding, and wherein the priorities are different at least in the state of warming up and the standby state.

5. The image forming apparatus of claim 1, wherein the fixation device comprises a fixing belt, a fixing roller, a heat roller which heats the fixing roller through the fixing belt, a pressure roller which comes into pressure contact with the fixing roller through the fixing belt, and an external heat roller which abuts on the pressure roller, and wherein the plurality of heaters are provided in the heat roller, the pressure roller, and the external heat roller.

6. The image forming apparatus of claim 5, wherein three or more of the plurality of heaters are provided in the heat roller.

* * * * *